US005809749A

United States Patent [19]

Ruggiero et al.

[11] Patent Number: 5,809,749

[45] Date of Patent: Sep. 22, 1998

[54] HIGH SPEED ENVELOPE PACKING APPARATUS

[75] Inventors: Ralph Ruggiero, Green Valley, Ariz.; Roman Golicz, Clinton, Conn.

[73] Assignee: Bell & Howell Cope Company, Tucson, Ariz.

[21] Appl. No.: 734,632

[22] Filed: Oct. 21, 1996

[51] Int. Cl.[6] ..... B65B 1/04

[52] U.S. Cl. ..... 53/473; 53/492; 53/381.5; 53/381.7

[58] Field of Search ..... 53/569, 381.5, 53/381.7, 473, 460, 54, 591, 389.1, 492; 271/2, 34, 3.01, 149, 150

[56] References Cited

U.S. PATENT DOCUMENTS

| | | | |
|---|---|---|---|
| Re. 24,459 | 4/1958 | Kern . | |
| 1,543,842 | 6/1925 | Gwinn et al. . | |
| 1,668,761 | 5/1928 | Coty et al. . | |
| 2,155,895 | 4/1939 | Gibson, Jr. . | |
| 2,628,465 | 2/1953 | Penley | 53/381.7 |
| 2,915,863 | 12/1959 | Kummer . | |
| 3,253,384 | 5/1966 | Huck et al. . | |
| 3,423,900 | 1/1969 | Orsinger . | |
| 3,450,307 | 6/1969 | Sutton | 271/2 |
| 3,872,649 | 3/1975 | Wimmer . | |
| 4,020,615 | 5/1977 | Irvine et al. | 271/2 |
| 4,039,180 | 8/1977 | Stocker . | |
| 4,512,562 | 4/1985 | Moll . | |
| 4,649,691 | 3/1987 | Buckholz . | |
| 4,772,004 | 9/1988 | Golicz . | |
| 4,844,435 | 7/1989 | Giannetti et al. . | |
| 4,852,334 | 8/1989 | Auerbach | 53/381.5 |
| 4,909,499 | 3/1990 | O'Brien et al. . | |
| 4,939,887 | 7/1990 | Haas et al. | 53/381.7 |
| 5,033,729 | 7/1991 | Struthers . | |
| 5,097,654 | 3/1992 | Latsounas et al. | 53/385.1 |
| 5,155,973 | 10/1992 | Hipko | 53/460 |
| 5,251,425 | 10/1993 | Kern . | |
| 5,326,088 | 7/1994 | Newsome | 271/3.01 |
| 5,415,068 | 5/1995 | Marzullo | 271/2 |
| 5,575,464 | 11/1996 | Martinez et al. | 271/2 |

FOREIGN PATENT DOCUMENTS

| | | |
|---|---|---|
| 1145654 | 10/1957 | France . |
| 2420078 | 11/1975 | Germany . |
| 2913428 | 10/1980 | Germany . |

*Primary Examiner*—James F. Coan
*Assistant Examiner*—Gene L. Kim
*Attorney, Agent, or Firm*—Patula & Associates

[57] ABSTRACT

An envelope packing apparatus for packing a plurality of envelopes with a packing material comprising a buffer stack for holding an accumulated stack of the envelopes and a packing assembly for accepting the envelopes from the buffer stack and inserting the packing material into the envelopes.

25 Claims, 11 Drawing Sheets

CLASS SUBCLASS

HIGH SPEED ENVELOPE PACKING APPARATUS

BACKGROUND OF THE INVENTION

1. Field of the Invention

The instant invention relates generally to an apparatus for the rapid packing of envelopes. The instant invention provides a novel apparatus for the packing of envelopes which increases the rate at which envelopes may be packed. More specifically, the instant invention provides for an apparatus which reduces the number of operations required to pack each envelope and which also performs each operation more efficiently than previous configurations in order to increase speed. Furthermore, buffer zones are created between operations such that each operation need not be synchronized with the others thereby allowing the removal of defective envelopes from the apparatus and without interrupting a smooth continuous flow of envelopes to the subsequent operation. The packing rate of the instant apparatus is thereby increased.

2. Description of the Related Art

Prior attempts to create an envelope packing apparatus have employed complicated systems of rotating fingers, arms, pivoting packing plates and rollers. These complicated systems result in an excessive number of moving parts which raise the cost of construction and maintenance. More importantly, these complicated systems also lower the packing rate by employing unnecessary steps and creating pauses in the packing process.

A recent attempt at a high speed envelope packing apparatus which presents deficiencies typical of the prior art can be seen in U.S. Pat. No. 5,251,425 issued to Kern ('425 patent). The feeding assembly of the '425 patent employs a rotating opening element which must open the envelope flap prior to a conveyor element having an opportunity to remove that envelope such that a delay in feeding each envelope is experienced. Furthermore, because each operation is synchronized to the others, the delays in feeding time, as well as other operations, are perpetuated throughout the packing process and thereby cause a lower packing rate. Also, the '425 patent packing trap must move up and down in coordination with a hold down roller to accomplish packing of each envelope thereby slowing the packing operation. Lastly, the '425 apparatus lacks a defect detection system or any manner of dealing with defective envelopes.

Another attempt at an envelope packing apparatus can be seen in U.S. Pat. No. 4,649,691 to Buckholz ('691 patent). The '691 patent uses complicated clamping systems to hold each envelope and stuffing material during transport. Furthermore, the timing of these clamps must be carefully calibrated to ensure proper movement of the envelopes and stuffing. Like the '425 patent, the '691 patent presents a synchronous operation such that delays of any single operation are perpetuated throughout the entire apparatus and cumulated with delays of other operations. The packing assembly of the '691 patent also presents numerous changes of direction in the envelope path creating pauses and delays. Lastly, the '691 patent provides no detection and rejection assembly to remove unopened envelopes from the apparatus.

Another attempt at an envelope packing apparatus can be seen in U.S. Pat. No. 3,872,649 to Wimmer ('649 patent). The '649 patent presents only a packing apparatus without the advantage of the novel and efficient feeding assembly, defect detection means, buffer stacks and exiting conveyor of the instant invention. Furthermore, the packing apparatus of the '649 patent comprises a complex assembly of cams rollers and intermittently swinging arms which prevent the smooth and efficient operation of the instant packing assembly.

Another attempt at an envelope packing apparatus can be seen in U.S. Pat. No. 3,423,900 to Orsinger ('900 patent). Like the '691 apparatus, the '900 patent requires rotating wheels which must grab each envelope or packing material. This requires complicated coordination and excess moving parts. Furthermore, the '900 patent provides a synchronous machine such that inefficiencies are perpetuated and accumulated throughout the apparatus. The packing assembly requires a moving packing plate, a rotating envelope delivery wheel and two conveyors to insert the packing material into each envelope. Here again the problems of proper synchronization as well as the excess of moving parts present inefficiencies and higher costs of operation and maintenance.

Another attempt at an envelope packing apparatus can be seen in U.S. Pat. No. 3,253,384 to Huck et al. ('384 patent). The '384 patent requires a rotating suction head which must be coordinated with the opening of each envelope and the conveying wheel which then grasps the envelope from the rotating suction head. Thereafter, the '384 patent comprises a complex system of clamps, swinging arms and numerous changes of direction for the envelopes, all of which create losses of time in the packing apparatus. Furthermore, they create higher costs of operation and maintenance.

Another attempt at an envelope packing apparatus can be seen in U.S. Pat. No. 2,915,863 to Kummer ('863 patent). The '863 apparatus presents similar problems of timing due to wheels and clamps employed to move envelopes, as well as pauses due to change of direction of the envelope and packing material. The '863 patent presents further inefficiency in the packing assembly due to the pivoting required by the packing plate to remove stuffed envelopes and the resulting delay experienced between stuffing of envelopes.

Another attempt at an envelope packing apparatus can be seen in U.S. Pat. No. 1,668,761 to Coty et al. ('761 patent). The '761 patent presents a bag feeding apparatus which requires two distinct operations performed in series to open a bag and remove the bag from the reserve. Furthermore, as with the previously mentioned patents, the '761 apparatus comprises a complicated system of wheels and arms which must be properly timed thereby creating higher cost of operation and maintenance.

Another attempt at an envelope packing apparatus can be seen in U.S. Pat. No. 1,543,842 to Gwinn et al. ('842 patent). The '842 patent provides a vacuum feeding assembly comprising a moving suction head which must be driven from the envelope reserve to the packing area. Furthermore, each stuffed envelope must be removed from the packing plate prior to the suction head having clearance to return to the envelope reserve to grasp another envelope.

Another attempt at an envelope packing apparatus can be seen in U.S. Pat. No. Re. 24,459 to Kern which resembles the '863 patent and presents the same inefficiencies experienced therein.

It is therefore an object of the instant invention to provide a high speed envelope packing apparatus.

It is a further object of the instant invention to provide a high speed envelope feeding assembly which does not jeopardize the integrity of the envelopes.

It is a further object of the instant invention to provide a high speed envelope packing apparatus with a minimum number of moving parts.

It is a further object of the instant invention to provide a high speed envelope packing apparatus which performs a minimum number of operations on each envelope.

It is a further object of the instant invention to provide a high speed envelope packing apparatus which eliminates the need to synchronize operation of the envelope packing assembly to the envelope feeding assembly.

It is a further object of the instant invention to provide a high speed envelope packing apparatus which comprises a monitoring system to identify and remove defects.

SUMMARY OF THE INVENTION

The above and other objects of the instant invention are accomplished by providing an envelope packing apparatus which employs a simple envelope feeding assembly which minimizes delays in feeding envelopes, a defect detection and rejection means to remove defective envelopes from the apparatus prior to reaching the packing assembly, a simple and quick envelope packing assembly and a buffer stack of envelopes between the feeding assembly and packing assembly. The deficiencies of the prior art envelope feeding assemblies are overcome in the instant invention by forcing open the flap of each envelope in the envelope reserve by means of directing forced air onto said flap while the previous envelope is still in the process of being fed from the envelope reserve. The reserve envelopes rest in an upright position wherein the flap extends downward from the top of the envelope in a flap-closed position. The reserve envelopes are further orientated such that the flap of each envelope will extend to the exposed side of that envelope when it becomes the foremost envelope in the envelope reserve. A feeding conveyor means rests in contact with a lower portion of the foremost reserve envelope in the envelope reserve such that it does not contact the flap extending from the top of that envelope. Air pressure is continually exerted on the envelope reserve means in a manner such that the flap of a second in line envelope is blown to a flap-opened position the moment the foremost envelope has been fed downward and cleared the flap of that second in line envelope. In this manner, the flap of each envelope is opened before it is available to be fed from the envelope reserve. Therefore, the time required to open each envelope flap is not a factor in the overall processing time of an envelope. Other configurations of this concept are also disclosed hereinafter.

A sensor then checks each envelope to insure that the flap has opened. Envelopes which have not opened are detected and diverted from the stream of envelopes at that point. The remaining envelopes continue onward to a buffer stack of envelopes and then to the packing apparatus. The buffer stack of envelopes allows the packing apparatus to operate independently of the output from the feeding assembly or the defect detection and rejection means. Consequently, the packing assembly need not be synchronized to the feeding assembly. Furthermore, by making the feed rate dependant upon the number of envelopes in the buffer stack, the feeding assembly can speed up to replenish envelopes ejected from the system by the defect detection and rejection means. Therefore, a smooth, continuous flow of properly opened envelopes is delivered to the packing assembly.

The deficiencies of the prior art envelope packing assembly are overcome by employing a stationary packing trap and a threading roller connected to a laterally adjacent exiting platform. The exiting platform shifts downward to allow an envelope to be threaded onto the threading roller and then shifts upward as the threading roller advances the envelope such that the envelope is placed around the packing plate. The exiting platform then shifts back downward to thread another envelope while the envelope on the packing plate is packed and removed onto the top of the exiting platform. The difficulties typically experienced in coordinating the feeding process with the packing process are overcome by positioning the buffer stack of envelopes between the feeding assembly and the packing assembly.

Lastly, as each envelope leaves the exiting platform, it is dropped into a transfer unit which ejects the envelope to a stand-up subassembly to reorient each envelope to a vertical position. The glue of each envelope is then moistened by a reservoir such that when the adjacent contorted belt guides the envelope flap into contact with the envelope body, a sealed envelope is accomplished.

The instant envelope packing apparatus has a minimum of moving parts. Because the moving parts employed in the instant invention are mostly small rollers and belts employed to deliver envelopes from one operation to another the process may be accomplished at high speeds. The delays experienced by prior art envelope packing configurations are eliminated by the instant apparatus, in part, because the pivoting packing plates, large rollers, wheels, swinging arms, cams and numerous redirections of the envelopes are not employed.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT

Figure 1:
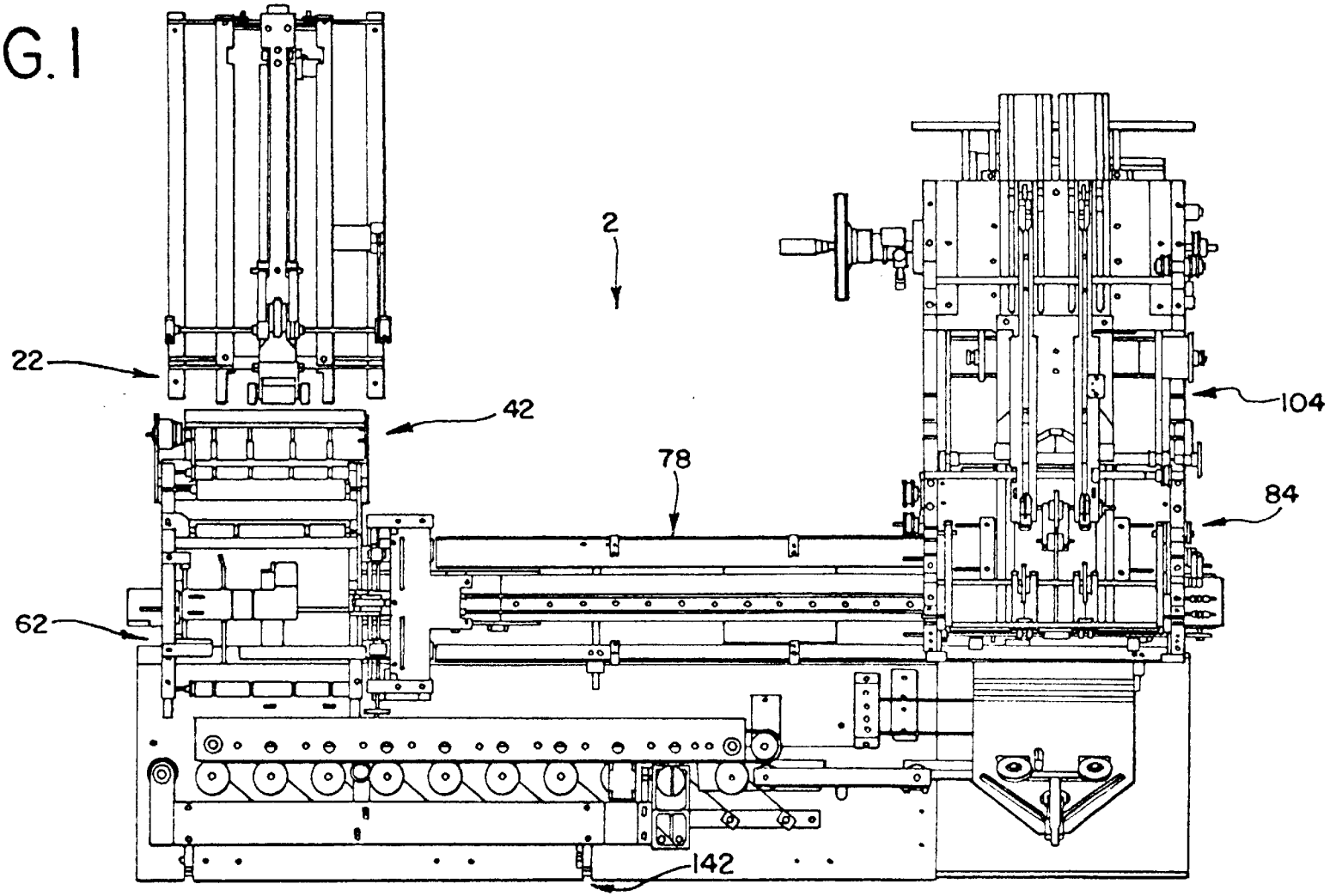
FIG. 1 is a substantially schematic top view of the envelope packing apparatus of the instant invention.

While the invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

Referring to the drawings wherein identical reference numerals denote the same elements throughout the various views, the present invention is accomplished in a preferred embodiment by the envelope packing apparatus 2 of FIG. 1. The envelopes for which the instant invention is configured to pack originate at an envelope feeding assembly 22 where the envelopes are opened, fed through a defect detection assembly 42 and into a first bottom feeder 62. From the first bottom feeder, each envelope is fed to an intermediate conveyor 78 which transports each respective envelope from the first bottom feeder 62 to a second bottom feeder 84 (not visible in FIG. 1) from which an envelope packing assembly 104 draws envelopes. Each envelope is packed with the desired materials at the envelope packing assembly 104 and exited to exiting conveyor 142. Exiting conveyor 142 then seals each packed envelope and transports them out of the apparatus.

Figure 2:
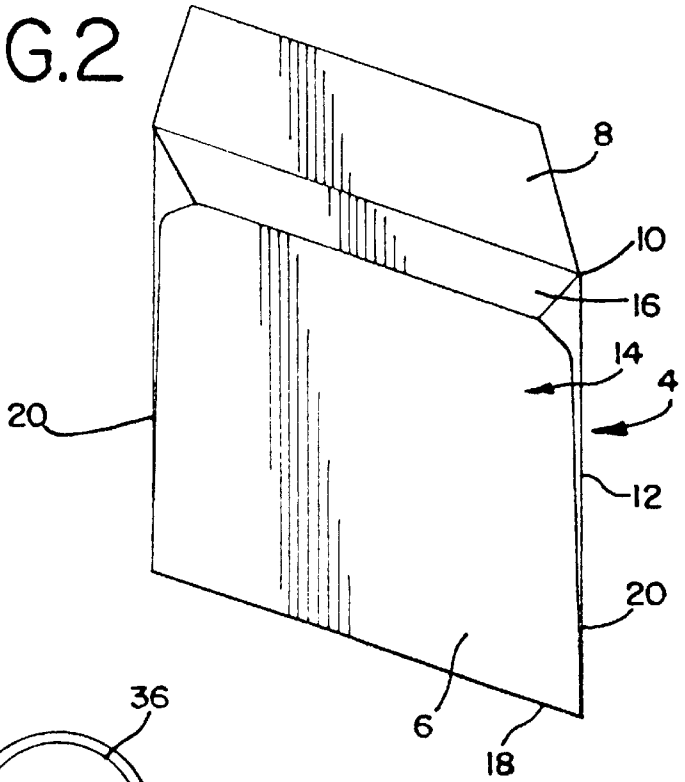
FIG. 2 is a substantially schematic perspective view of an envelope of a type which may be used with the instant invention.

A typical envelope 4 (depicted in FIG. 2) of the type used in the instant envelope packing apparatus 2 comprises an envelope body 6 and a flap 8. The flap 8 is connected to the body 6 at a connecting edge 10 thereof. The envelope body 6 comprises an envelope front wall 12 and an envelope back wall 14. The envelope front wall 12 and back wall 14 are connected at three sides but left unconnected at the side adjacent the connecting edge 10 to form an envelope opening 16. The connected side opposite the envelope opening 16 is an envelope bottom 18 and the two other connected sides are envelope sides 20.

Figure 3A:
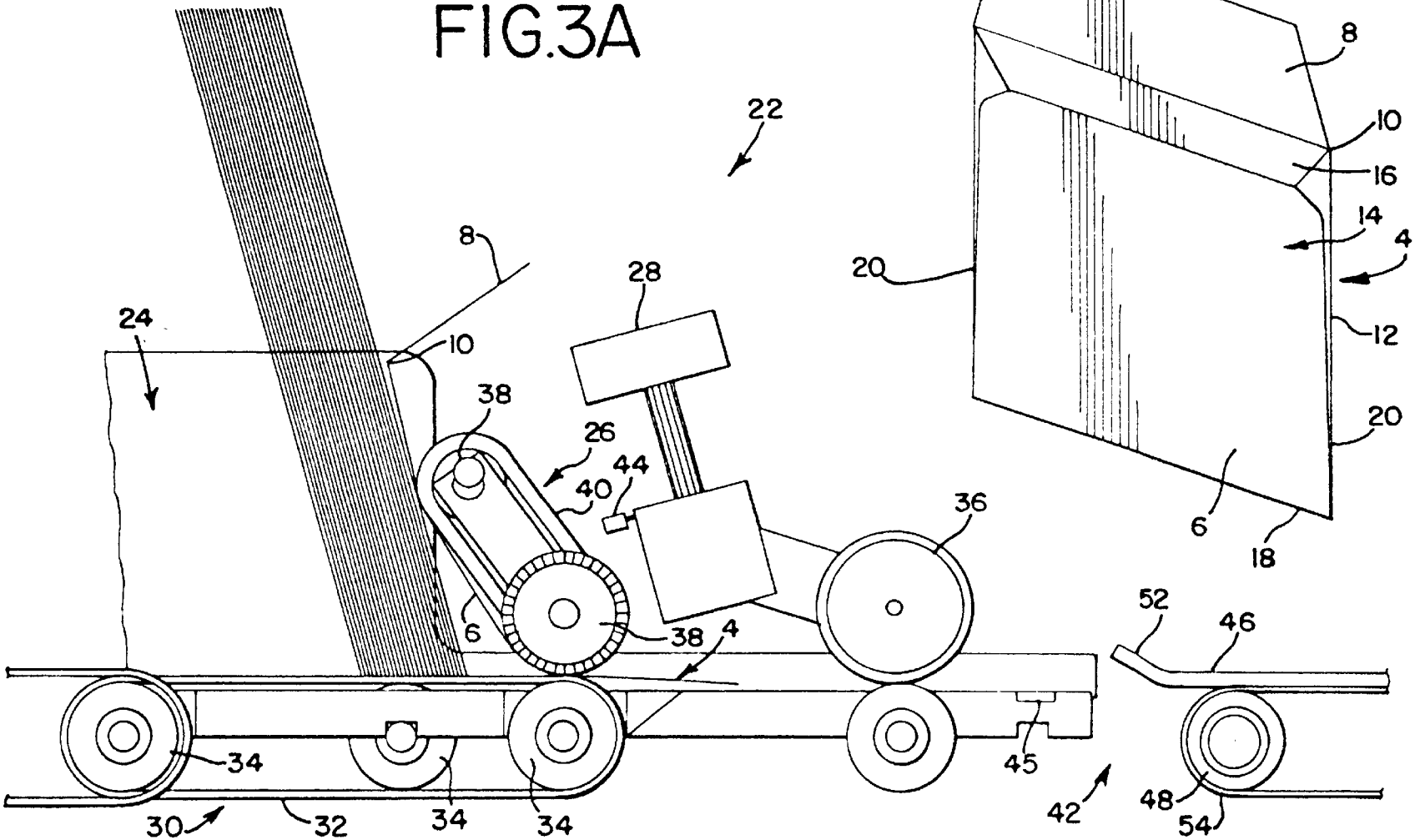
FIG. 3A is a substantially schematic cross-sectional view of the feeding assembly and the sensor of the defect detection and rejection means of the instant invention.
Figure 3B:
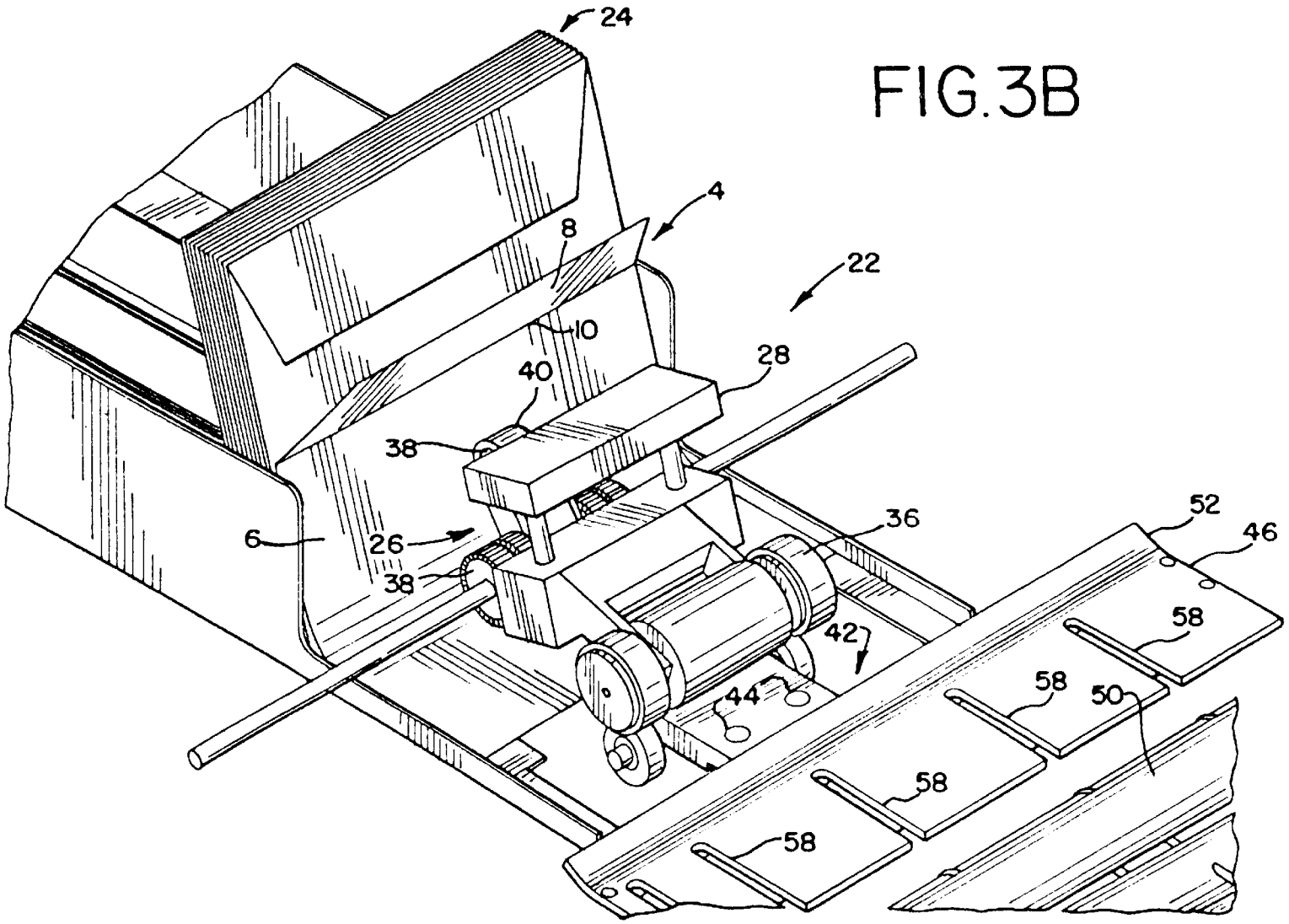
FIG. 3B is a substantially schematic perspective view of the feeding assembly of the instant invention.

The envelope feeding assembly 22 avoids the delays and complications associated with the prior art methods of feeding envelopes by the simple assembly comprising a minimum of moving parts herein described and depicted in FIGS. 3A and 3B. The preferred envelope feeding assembly 22 comprises an envelope reserve means 24 to hold a reserve of envelopes 4 and a first envelope feeding conveyor 26 adapted to urge a foremost envelope in the envelope reserve means 24 downward and out of the envelope reserve means 24. A flap opening means 28 for forcing open the flap of each envelope is positioned adjacent the first envelope feeding conveyor 26.

The envelope reserve means 24 is configured to hold a reserve of envelopes 4 therein in a flap-closed configuration. The flap-closed configuration comprises the flap 8 of the envelope 4 folded along connecting edge 10 and resting over the envelope body 6. Because envelopes are typically sold in this flap-closed configuration for packaging and shipping efficiency, the instant invention is configured to accept envelopes in this flap-closed configuration.

Furthermore, each envelope is preferably oriented in the envelope reserve means 24 such that the connecting edge 10 of the envelope 4 represents the top of the envelope such that the envelope flap 8 extends downward and overlies envelope body 6. The connecting edge 10 of the envelope body 6 defines a crease formed by folding the envelope flap 8 over the envelope body 6. The envelopes 4 are further oriented such that the flap 8 faces the first envelope feeding conveyor 26 and flap opening means 28 such that the flap 8 of the foremost envelope 4 in the envelope reserve means 24 will be adjacent the first feeding conveyor 26. This configuration is depicted in FIGS. 3A and 3B.

The envelope reserve means 24 is configured such that the foremost reserve envelope is urged into contact with the envelope first feeding conveyor 26 by a reserve means advancer 30. The various envelope reserve means and reserve means advancers known in the art are contemplated. The preferred reserve means advancer 30, depicted in FIGS. 3A and 3B comprises a belt 32 positioned around a plurality of rollers 34. An envelope support means 35 keeps the envelopes in an upright position. In operation, the envelopes rest on belt 32 which advances the reserve envelopes toward the first feeding conveyor 26 such that the foremost envelope 4 is in contact with that first feeding conveyor 26. Furthermore, it is to be understood that the orientation of the envelope reserve means 24 depicted in FIGS. 3A and 3B is merely the preferred embodiment and that any configuration or orientation would suffice. It is also to be understood that known methods and apparatus for continuous reloading of the envelope reserve means 24 are contemplated as well.

In the preferred embodiment of the envelope feeding assembly 22, the first feeding conveyor 26 is configured to rest in contact with the body 6 of the foremost envelope in the envelope reserve means 24 such that envelope flap 8 of that envelope may swing open freely without interference from the first feeding conveyor 26 when the foremost envelope is substantially undisplaced from the envelope reserve means 24. Flap opening means 28 lies opposite of the envelope reserve means 24 from the first feeding conveyor 26. The flap opening means 28 is adapted to emit a stream of air directed toward the foremost envelope of the envelope reserve means 24 in a manner which will rotate the envelope flap 8 of a foremost envelope into the flap-opened position. Consequently, the flap 8 of each envelope will be rotated into the flap-open position while substantially undisplaced from the envelope reserve means 24.

As that foremost envelope is drawn down, the second-in-line envelope which rests immediate adjacent to the foremost envelope is increasingly exposed until the foremost envelope has cleared the entire flap 8 of the second-in-line envelope. Once the envelope flap 8 of the second-in-line envelope is no longer covered by the foremost envelope, the stream of air pressure emanating from the flap opening means 28 will catch the envelope flap 8 of the second-in-line envelope, rotate it into the flap-opened position and hold that flap 8 in that position until that envelope 4 has become the foremost envelope and is drawn down by the first feeding conveyor 26.

It is to be understood that any manner known in the art of creating said air pressure may be employed as the flap opening means 28. These may include, but are not limited to, piping in pre-compressed air or adapting a fan to act as the flap opening means. Furthermore, the flap opening means 28 is movable both vertically and angularly to ensure that the airstream of the flap opening means 28 may strike the flap 8 of the foremost envelope at an angle which would most efficiently open the flap 8 of that envelope regardless of said envelope's size. Furthermore, it is to be understood that other flap opening means may be employed in conjunction with the instant envelope packing apparatus 2 without departing from the scope thereof.

When configured in the above described preferred orientation, the feeding assembly of the instant invention will blow open the flap 8 of the foremost envelope of the envelope reserve means 24 and that foremost envelope will be drawn down and away from the envelope reserve means 24 by first feeding conveyor 26 toward the defect detection means 42 in the flap-opened position. Prior to the foremost envelope being drawn down by the first feeding conveyor 26, the envelope flap 8, although held in the open position by the flap opening means 28, is biased toward the flap-closed position due the a crease in the envelope running along the connecting edge 10 of the envelope body 6. However, when the connecting edge 10 of the envelope body 6 passes between the first feeding conveyor 26 and the second-in-line envelope, the crease in the envelope is substantially flattened such that the envelope flap 8 is thereafter biased toward the flap-open position.

In the first preferred embodiment shown generally in FIGS. 3A and 3B, a second feeding conveyor 36 may be positioned between the first feeding conveyor 26 and the defect detection means 42. The second feeding conveyor 36 is adapted to contact an envelope drawn by the first feeding conveyor 26 prior to that envelope completely leaving contact with the first feeding conveyor 26. In this manner, the second feeding conveyor 36 assures that each envelope 4 is quickly directed to the defect detection means 42. The second feeding conveyor 36 serves the additional purpose of further flattening the crease at the connecting edge 10 of the envelope body 6 such that the flap 8 of each envelope is insured to be biased to the flap-opened position and each envelope exiting the feeding assembly 22 of the instant invention will lie substantially flat.

In a second preferred embodiment (not depicted), a first feeding conveyor 26' is not positioned to be clear of the flap 8 of the foremost envelope in the envelope reserve means 24 while it rests thereon. Rather, the first feeding conveyor 26' rests on at least a portion of flap 8 of the foremost envelope in the envelope reserve means 24. In this embodiment, the flap opening means 28' is configured such that when the first feeding conveyor 26' has drawn down and urged the foremost envelope of the envelope reserve means 24 toward the defect detection means 42 and out of contact with the first feeding conveyor 26', the stream of air pressure emitted from flap opening means 28' will catch the flap 8 of that envelope and rotate it into the flap-opened position. This embodiment also preferably employs a second feeding conveyor 36' to ensure quick direction of each envelope to the defect detection means 42 and to ensure that the each envelope 4 is not displaced by the air pressure emitted from the flap opening means 28'. Furthermore, the second feeding conveyor 36' serves as the primary means for biasing each envelope flap 32 to the flap-open position in this configuration.

The feeding conveyors 26,26',36,36' are preferably rollers mounted on rotating shaft members. The preferred first feeding conveyor 26 is preferably comprised of two radially disparate rollers 38 adapted to accept a belt 40 to drive the rollers. However, a single roller could also serve the function of feeding an envelope without substantially affecting the improvements presented in the instant envelope feeding assembly 22.

In the first embodiment described above, the time required to open the flap 8 of each envelope 4 is not added into the process time of each envelope because the flap is forced open by the air pressure emitted by the flap opening means 28 prior to that envelope being the foremost envelope. In other words, before the first feeding conveyor even contacts an envelope 4 in the envelope reserve means 24 the flap 8 on that envelope 4 has been blown open. Consequently, the time required to open the flap 8 of an envelope 4 becomes irrelevant to the feeding rate of the instant envelope packing apparatus 2.

In the second embodiment described above, the time required to open the flap 8 of each envelope 4 is not added into the process time of each envelope because the flap is forced open by the air pressure emitted by the flap opening means 28' while the envelope is being transported from envelope reserve means 24 to the defect detection means 42. In other words, the flap opening operation is accomplished simultaneously with another operation such that the time required to open the flap 8 of each envelope 4 becomes irrelevant to the packing rate of the instant packing apparatus 2.

In addition to rendering the time required to open the flap 8 of each envelope 4 irrelevant, the instant invention is accomplished in a simple manner with a minimum of parts to reduce manufacturing and maintenance costs. The instant invention requires only the first feeding conveyor 26 and the flap opening element 28. It is to be understood that other configurations and orientations of the above described envelope feeding apparatus which may be employed do not depart from the scope of the instant invention.

The defect detection means 42 is positioned adjacent the feeding assembly 22. The preferred embodiment of the defect detection means 42 can be seen generally in FIGS. 3A,4A and 4B. The defect detection means 42 comprises a fiber optic sensor 44 positioned adjacent to the flap opening means 28. The sensor 44 is directed upward toward the foremost envelope 4 in the envelope reserve means 24. The flap 8 of an envelope 4 having said flap 8 blown open by the flap opening means 28 will hang downward in front of the envelope as depicted in FIG. 3A. The amount which that flap 8 hangs down will depend upon the force of the air directed at that flap 8. If a flap 8 does not open, upon contacting the air of the flap opening means 28, the flap will not be hanging outward of the envelope body 6. Therefore, the sensor 44 can distinguish whether the flap 8 on the foremost envelope 4 has opened by whether of not it detects the flap 8 hanging outward of the envelope body 6.

A second sensor 45 is positioned at the exit of the feeding assembly 22 and under the path of travel of the envelopes. The sensor 45 is employed to detect whether or not an envelope 4 has been fed. This information can be used to signal malfunction in the feeding assembly 22 or an empty envelope reserve means 24.

A rejection arm 46 is positioned above a first roller 48 and laterally adjacent to the sensor 44. A second roller 50 is positioned at a distance from the first roller 48. Rejection arm 46 comprises a downwardly angled portion 52 at the front thereof. As each envelope 4 exits the feeding assembly 22 it encounters rejection arm 46. The downwardly angled portion 52 guides the leading edge of each envelope under the rejection arm 46 such that the rotation of the first roller 48 will draw each envelope 4 between the first roller and the rejection arm 46.

First roller 48 is rotated by a belt 54 placed around the first roller 48 and the second roller 50. The gap between the first roller 48 and second roller 50 is left otherwise completely unobstructed such that the rejection arm 46 may be rotated to deflect defective envelopes downward between the first and second rollers 48,50 to remove them from the system.

Figure 4A:
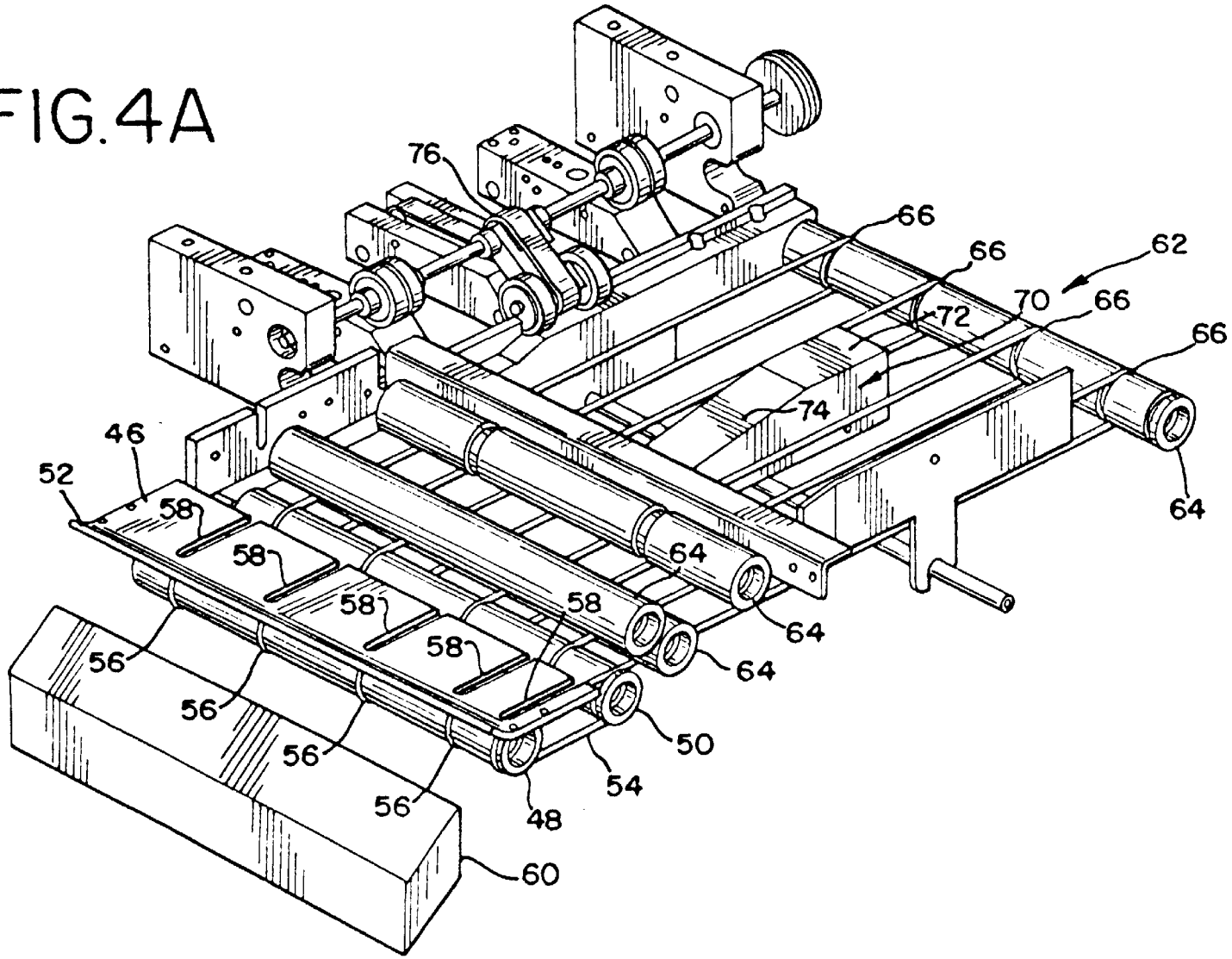
FIG. 4A is a substantially schematic perspective view of the rejection portion of the defect detection and rejection means and the first bottom feeder of the instant invention.
Figure 4B:
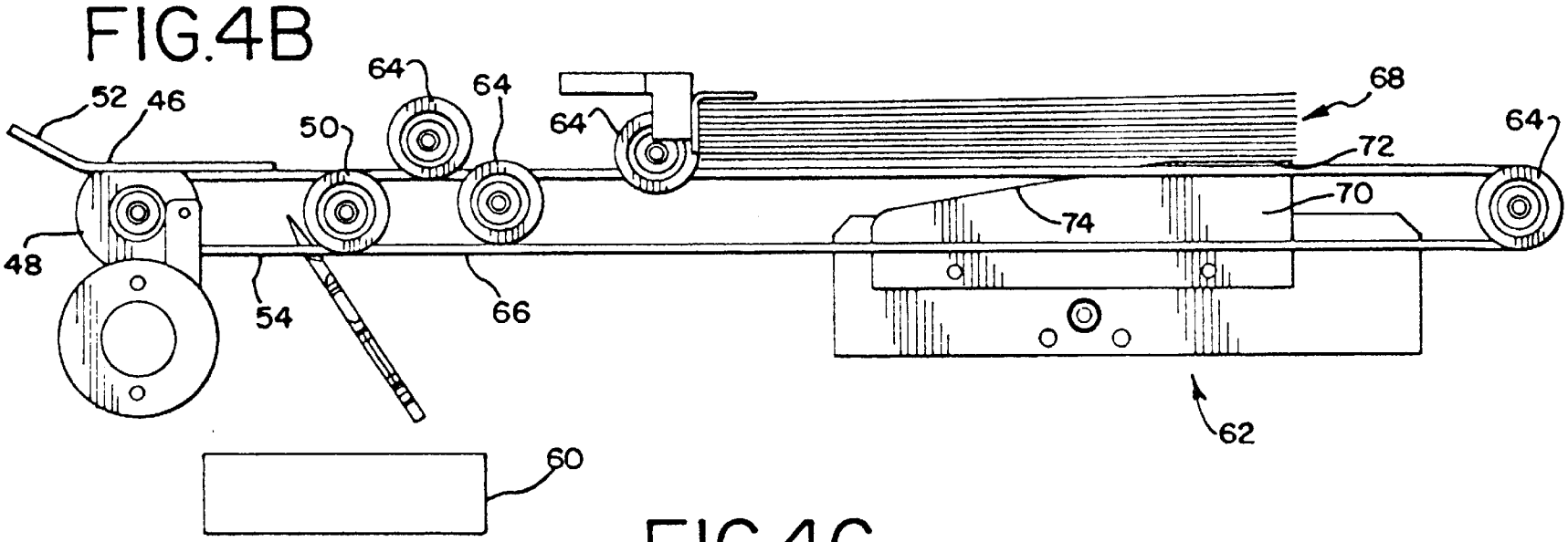
FIG. 4B is a substantially schematic cross-sectional view of the rejection portion of the defect detection and rejection means and the first bottom feeder of the instant invention.

To ensure that each envelope 4 leaving the feeding assembly 22, whether defective or not, is properly propelled through the defect detection assembly 42, the first roller 48 preferably comprises a plurality of rings 56 therealong. Each of the plurality of rings 56 protrudes beyond the outer circumference of the first roller 48 such that each envelope rests on the plurality of rings 56 as it passes between the first roller 48 and the rejection arm 46. As best seen in FIG. 4A, the rejection arm 46 preferably comprises a plurality of slots 58 positioned above the first roller 48 such that each of the plurality of rings 56 located along the first roller 48 has a corresponding slot 30 located thereabove. The rejection arm 46 is preferably positioned at a distance from the outer circumference of the plurality of rings 56 which is less than the thickness of each envelope 4 to travel therebetween. In this manner, the plurality of rings 56 may slightly deform each envelope 4 into the plurality of slots 58 along the rejection arm to assure proper friction between the plurality of rings and the envelope 4. Proper friction can be further assured by employing a proper material for said rings 56.

When an envelope 4 has not been properly opened, the sensor 44 sends a signal to the rejection arm 46 and the slotted end of that rejection arm rotates downward between the first and second roller 48,50 to deflect the defective envelope 4 out of the system and into a defect area 60.

All properly opened envelopes proceed from the first roller 48 to the second roller 50 unobstructed by rejection arm 46 and then to the bottom stacking assembly 62. The first roller 48 turns in continuous rotation to feed each consecutive envelope 4 to the entrance to the first bottom feeder 62 which comprises a plurality of rollers 64 which operate in conjunction with the second roller 50 of the defect detection means 42 to rotate a plurality of transport belts 66. Transport belts 66 are continuous belts which extend from the second roller 50 to the first bottom feeder for transporting each consecutive envelope 4 from the defect detection area 42 to the buffer stack 68.

The first bottom feeder 62 places each envelope fed from the transport belts 66 at the bottom of the buffer stack 68. This is accomplished by positioning an elevating base 70 at the bottom of the buffer stack 68 between transport belts 66. The elevating base 70 is positioned in the path of the transport belts 66 such that each envelope 4 delivered by the transport belt is elevated off the transport belt to an elevated platform 72 by an elevating ramp 74 of the elevating base 70. In normal operation, a plurality of envelopes will rest atop of the elevated platform 72 to constitute the buffer stack 68. As a new envelope is delivered by the transport belt 66 it contacts the elevating ramp 74 and is slid under the bottom most envelope in the buffer stack 68 such that the bottom most envelope is raised off of the elevated platform 72 to rest on the newly positioned envelope. In this manner, when each envelope in the buffer stack 68 is removed from the top thereof a first-in-first-out procession is accomplished in the first bottom feeder 62. In other words, the envelopes proceed from the first bottom feeder 62 in the same order that they came into the first bottom feeder 62.

Each envelope 4 is removed from the buffer stack 68 by a buffer stack prompter 76 which may remove the uppermost envelope of the first buffer stack 68 regardless of the number of envelopes in said buffer stack 68. The buffer stack prompter 76 rests atop the buffer stack 68 and consecutively feeds envelopes 4 to the intermediate conveyor 78. In a preferred configuration, the buffer stack prompter 76 comprises a roller which can rotate either continuously or intermittently to supply the envelopes to the intermediate conveyor 78 as needed to supply a continuous and uninterrupted supply of envelopes to the packing assembly 104.

It should be understood that the buffer stack 68 allows for a smooth and uninterrupted flow of envelopes to the intermediate conveyor 78, and ultimately to the packing assembly 104, in spite of the fact that envelopes may have been removed at the defect detection assembly 42. This is accomplished by conditioning the feeding of each envelope 4 by the feeding assembly 22 upon the number of envelopes, or alternatively the height of envelopes, in the buffer stack 68. When an envelope is rejected from the stream of envelopes by the defect detection assembly 42 the number of envelopes coming into the buffer stack 68 will be less than the number of envelopes being removed from the buffer stack 68. The level of the buffer stack 68 will necessarily, therefore, decrease. By conditioning the rate at which envelopes are feed from the feeding assembly 22 upon the level of the buffer stack 68 the envelope feed rate can be increased when an envelope has been rejected from the stream of envelopes in order to bring the level of the buffer stack 68 back to the desired operating level. Since the level of the buffer stack 68 is returned to normal operating level before that buffer stack 68 is depleted of envelopes, no interruption of envelope supply to the intermediate conveyor 78 is experienced. A smooth and uninterrupted flow of envelopes to the packing assembly 40 is thereby accomplished in spite of failure of some envelopes 4 to open. Because the down time experienced by previous assemblies not employing defect detection and rejection means and bottom stackers caused loss of production and therefore loss of profits, the above configuration presents important improvements over the prior art.

Figure 4C:
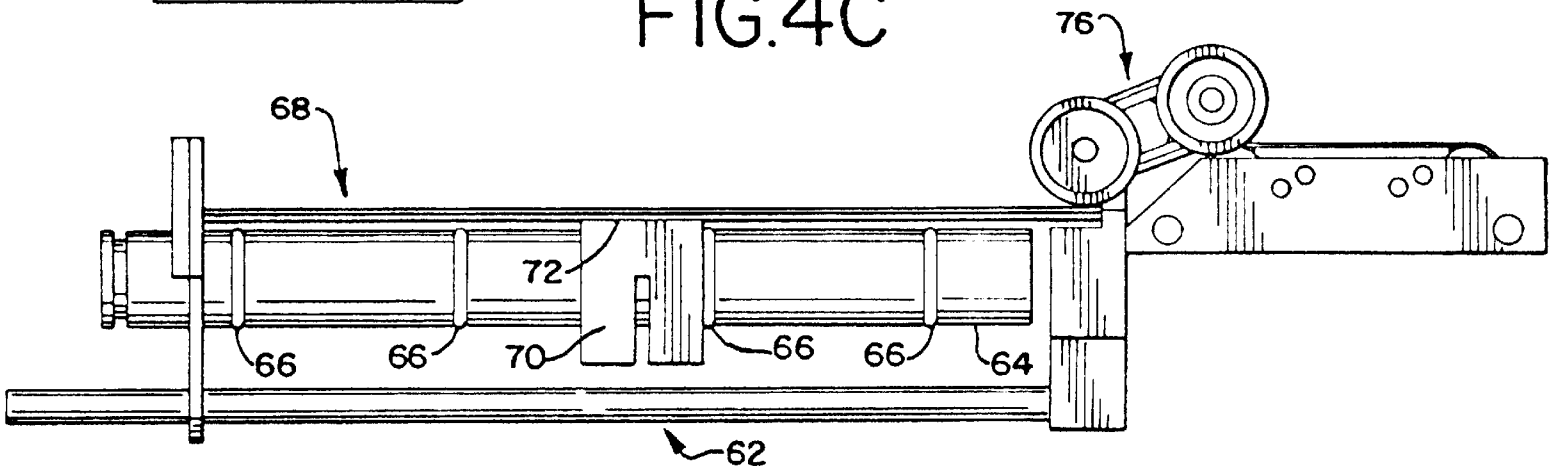
FIG. 4C is a substantially schematic cross-sectional view of the first bottom feeder of the instant invention.

The intermediate conveyor 78 is preferably a vacuum conveyor which extends from the first bottom feeder 62 to the second bottom feeder 84. The envelopes fed to the intermediate conveyor 78 are drawn from the top of the buffer stack 68 and to the side thereof (see FIGS. 4A and 4C). Because the envelopes are drawn to the side of the buffer stack 68, the envelopes proceed along the intermediate conveyor 78 with a side edge 20 of the envelope 4 representing the leading edge thereof rather than the bottom edge 18 of the envelope 4 as was the case in the feeding assembly 22. It should be recognized, however, that because the envelope front wall 12 lies adjacent the intermediate conveyor 78 the open flap of the envelope still lies on the bottom side of the envelope such that it also is immediately adjacent the intermediate conveyor 78. The intermediate conveyor terminates at the second bottom feeder 84.

The intermediate conveyor 78 preferably comprises at least one vacuum conveyor belt 80 which runs along its length and a plurality of vacuum ports 82 positioned adjacent thereto. As described above, each envelope 4 is projected onto the intermediate conveyor 78 by the buffer stack prompter 76. Each envelope 4 lands upon the vacuum conveyor belt 80 of the intermediate conveyor 78 and is then sucked down by the vacuum ports 82 located therealong such that each envelope 4 remains in substantial contact with the vacuum conveyor belt 80. In this configuration, each envelope 4 may be transported from the first bottom feeder 62 to the second bottom feeder 84 at a high rate of speed by the vacuum conveyor belt 80 without the envelope lifting from the vacuum conveyor belt 80 as a result of the envelope catching air at its underside thereby forcing the envelope off of the vacuum conveyor belt 80.

Figure 5:
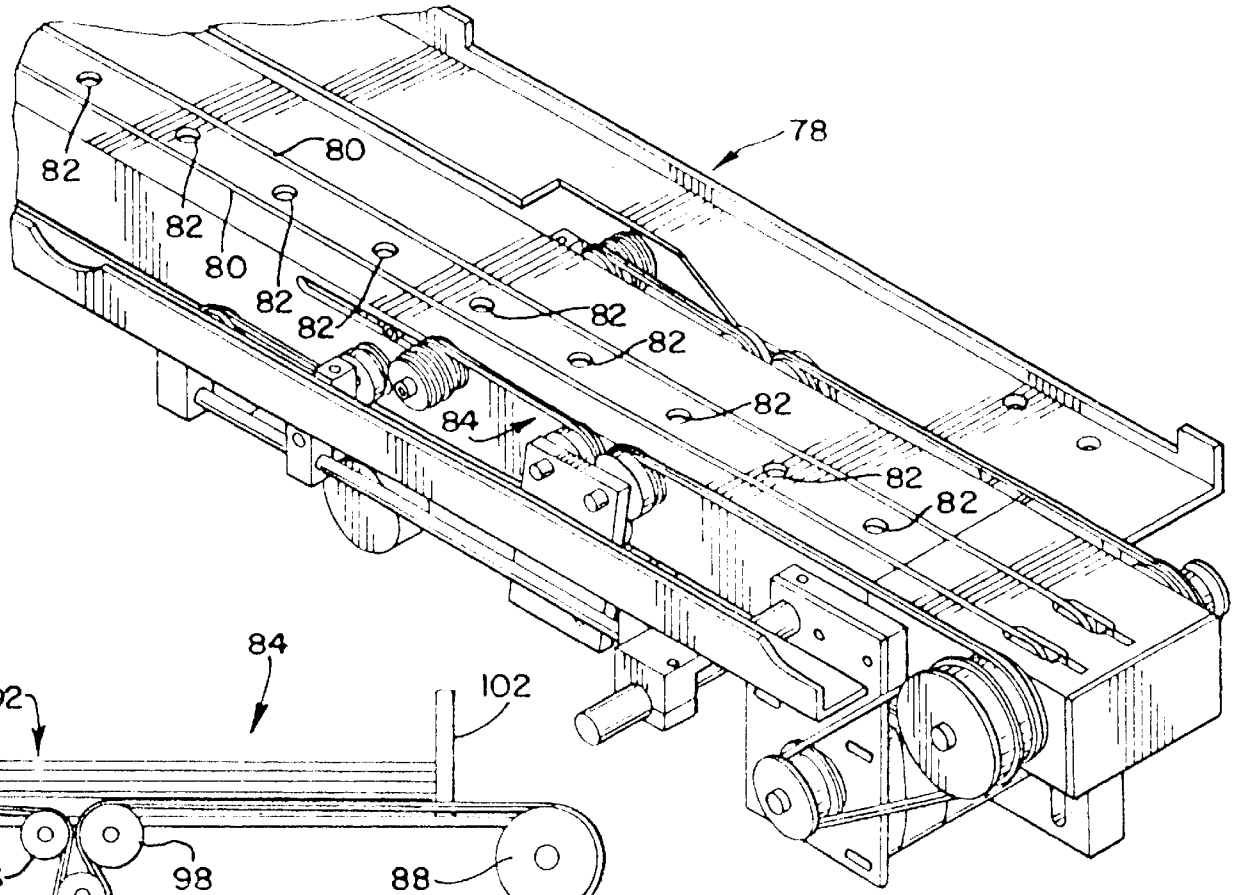
FIG. 5 is a substantially schematic perspective view of the intermediate conveyor.

FIG. 5 depicts the preferred configuration of the intermediate conveyor ending at the second bottom feeder 84. That preferred configuration comprises a plurality of vacuum ports 82 positioned substantially at the middle of the intermediate conveyor 78 along the length thereof. That configuration further comprises two vacuum conveyor belts 80. The vacuum conveyor belts 80 run on opposite sides of the vacuum ports 82 along the length of the intermediate conveyor 78 such that the force created on each envelope 4 by the vacuum ports 80 is directed onto the vacuum conveyor belts 80. As depicted in FIG. 5, the vacuum conveyor belts 80 and vacuum ports 82 continue to the end of the conveyor and under the second bottom feeder 84 which lifts each envelope 4 off of the vacuum conveyor belts 80.

The preferred configuration of the second bottom feeder 84 differs from that of the first bottom feeder 62. The preferred second bottom feeder 84 is depicted generally in FIGS. 5 and 6. It should be noted that although the preferred envelope packing apparatus 2 comprises first bottom feeder 62 and second bottom feeder 84 in the orientations described herein and depicted in FIG. 1, the configurations could be exchanged one for the other without substantially affecting the performance of the envelope packing assembly 104. In the same respect, first and second bottom feeder 62,84 could both be of the same configuration representing either that of the first or second bottom feeder 62,84.

Figure 6:
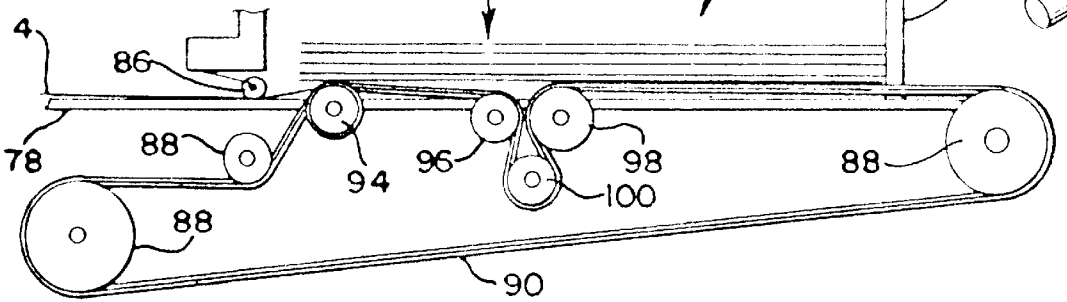
FIG. 6 is a substantially schematic cross-sectional view of the second bottom feeder.

Each envelope 4 traveling along the intermediate conveyor 78 flows from that intermediate conveyor into the second bottom feeder 84 as depicted in FIG. 5 and FIG. 6. The preferred second bottom feeder 84 comprises a tension roller 86 at the entrance thereto. Adjacent the tension roller 86 is positioned a plurality of rollers 88 and tensioned belts 90 which extends around the plurality of rollers 88 to propel each consecutive envelope 4 from the intermediate conveyor 78 to the bottom of the second buffer stack 92 of envelopes.

The plurality of rollers 88 comprises a first roller 94, a second roller 96, a third roller 98 and a fourth roller 100. First roller 94 is positioned adjacent to tension roller 86 at the entrance to the second bottom feeder 84. The first roller 94 is positioned above the level of the intermediate conveyor 78 such that upon reaching the tensioned belts 90 extending around the first roller 94, each envelope 4 will be raised upward forcing the leading edge of each envelope 4 to push upward the second buffer stack 92. Each envelope is then slide under the stack of envelopes 92 until it encounters the second bottom feeder stop 102. In this manner, each envelop entering the second bottom feeder 84 will be placed at the bottom of the second buffer stack 92.

The second, third and fourth rollers 96,98,100 of the plurality of rollers 88 are positioned underneath the second buffer stack 92 in a manner which allows for better stacking of envelopes having, what are traditionally called, windows therein. A window generally refers to a substantially rectangular portion cut out of the envelope and sometimes covered with a clear material, typically cellophane, such that portions of the contents of the envelope may be read without opening the envelope.

The accommodation of windowed envelopes is accomplished by adapting the second roller 96 such that its top is lower than the top of the first roller 94 and adapting the third roller 98 such that its top is at a higher level than the second roller 96. Preferably, the top of the third roller 98 is at approximately the same level as the top of the first roller 94. The fourth roller 100 is positioned below and between the second and third roller 96,98 such that tensioned belts 90 can be run over first roller 94, down to second roller 96, down and around fourth roller 100 and back up to third roller 98. Because the envelope buffer stack 92 rests on the tensioned belt 90 of the two highest rollers, first roller 94 and second roller 96, this configuration presents an gap between the tensioned belt 90 and the envelope buffer stack 92 from the first roller 94 to the third roller 98.

This gap allows for an air cushion between the buffer stack 92 and each envelope which is being inserted under the buffer stack 92 from the intermediate conveyor 78. This air cushion lessens the friction between the buffer stack 92 and the envelope 4 being inserted such that easier stacking within the second bottom feeder 84 is achieved. Lessening friction is of special concern when the envelopes employed in the envelope packing apparatus 104 have windows therein. The cellophane material, and others typically employed in said windows, create a higher friction between the envelopes than do envelopes without windows. Also, the envelopes 4 in the second buffer stack 92 are oriented such that the envelope front wall 12 is immediately adjacent the tensioned belt 90 of the second bottom feeder 84. Since envelope windows are typically placed on the front wall 12 of an envelope, the windows present envelope portions which may be caught and damaged by an incoming envelope in the instant second bottom feeder 84. Therefore, the air cushion allows an incoming envelope 4 to avoid getting caught in the envelope window of the envelope on the bottom of the second buffer stack 92. Consequently, this configuration of an bottom feeder is preferable when employing envelopes with windows.

The second, third and fourth rollers 96,98,100 are preferably configured as a sub-assembly of the second bottom feeder 84 such that they may be moved closer to or further from the first roller 94. In this manner, the gap between the tensioned belt 90 and the bottom envelope of the envelope buffer stack 92 may be lengthened or shortened to accommodate varying placement or length of the window employed by the envelopes which are being used in the envelope packing apparatus 2. It is to be understood that other known configurations of stackers could be employed with the instant envelope packing apparatus 2 without substantially affecting the benefits derived from the other inventive aspects of the instant invention.

Referring generally to FIGS. 7A–7D, the envelope packing assembly 104 of the instant invention comprises a packing prompter 106 for urging each consecutive envelope from the top of the second buffer stack 92 toward a threading means 108 and a packing plate 110. In operation, packing prompter 106 removes each consecutive uppermost envelope from the second buffer stack 92 and urges it toward the threading means 108.

The second buffer stack 92 is adapted to hold a plurality of envelopes 4 in the flap-opened position for further processing by the packing assembly 104. In operation, the second buffer stack 92 preferably accumulates a plurality of envelopes at start-up of the instant apparatus and maintains a plurality therein during operation of the apparatus in the same manner as the first bottom feeder 62 such that the packing prompter 106 may draw from the second buffer stack 92 as it needs envelopes.

The envelope packing apparatus 2 of the instant invention is configured such that the packing prompter 106 will first engage the flap 8 of each consecutive uppermost envelope of the second buffer stack 92 and draw that opened flap 3 as the leading edge of the envelope into the packing assembly 104. In this orientation, the packing prompter 106 will release the envelope by urging the trailing edge, comprising the envelope bottom 18, along a bridge conveyor 138 toward the threading means 108. Consequently, the envelope flap 8 will be the first portion of the envelope to contact the threading means 108 and the envelope opening 16 will follow. Therefore, when the envelope 4 is urged toward the packing plate 110 by the threading means 108, the packing plate 110 will encounter the envelope opening 16.

In the preferred embodiment, packing prompter 106 comprises a first and second roller 112,114. First roller 112 rests atop the second buffer stack 92 to provide the initial force to each envelope 4. The second roller 114 then guides the displaced envelope to the bridge conveyor 138. Bridge conveyor 138 preferably comprises two rollers with a belt configured therearound such that envelopes leaving the packing prompter 106 are guided onto threading roller 108. However, any means of achieving proper delivery from the packing prompter 106 to the threading means 108 is contemplated.

The threading means 108 is adapted to raise the flap 8 of each consecutive envelope 4 into an alignment with the packing plate 110 as that flap 8 is placed on the threading roller 108 by the bridge conveyor 138. Threading means 108 is preferably a driven roller mounted adjacent the bridge conveyor 138 to accept envelopes 4 delivered therefrom and then deliver those envelopes to the packing plate 110. In a preferred operation threading is accomplished by the threading means 108 with the flap 8 of each consecutive envelope 4 being raised upward to be positioned adjacent the packing plate 110 such that mounting of the envelope 4 on the packing plate 110 may then be accomplished by continued urging of the envelope 4 toward the packing plate 110. Threading means 108 is therefore provided with rotation to impart said continued urging.

Figure 7C:
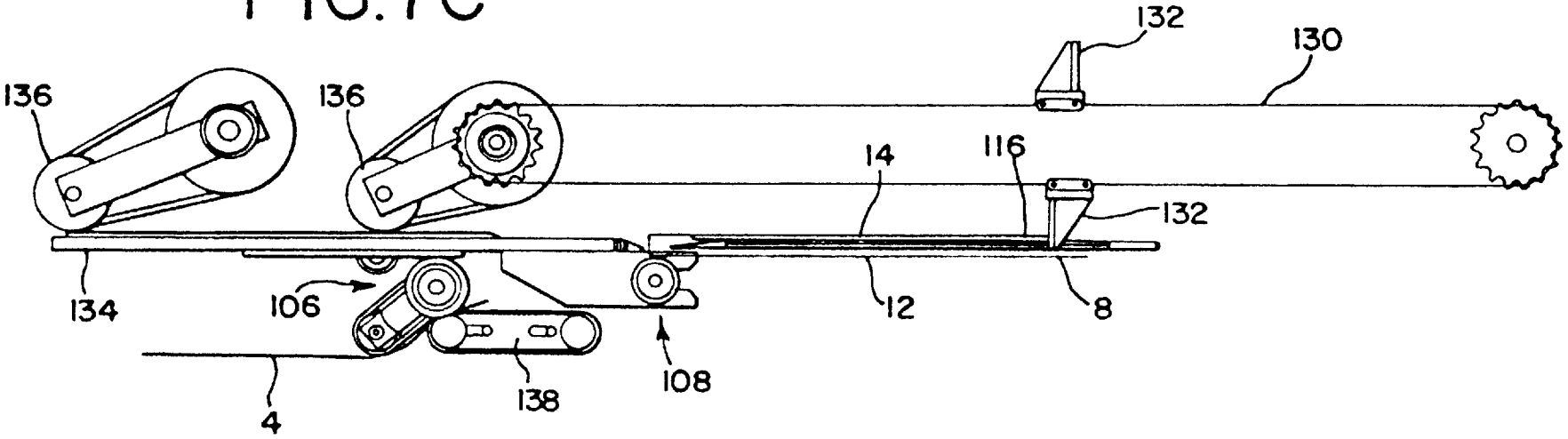
FIG. 7C is a substantially schematic cross-sectional view of the envelope packing assembly with an envelope being placed on the packing plate by the threading conveyor.
Figure 8:
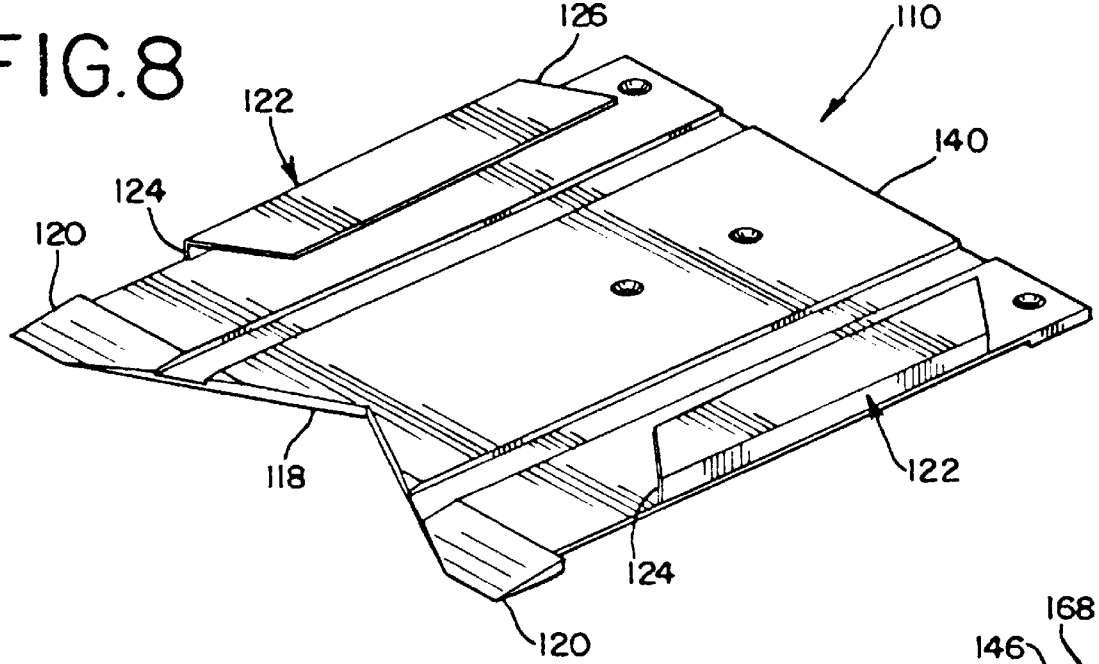
FIG. 8 is a substantially schematic perspective view of the packing plate.

The preferred packing plate 110, shown in FIG. 8, is configured to separate envelope front wall 12 from envelope back wall 14 at the envelope opening 16 upon the envelope 4 being slid onto the packing plate 110. This is accomplished as described above by means of the rotating threading means 108 which raises each envelope to the packing plate 110 and forces it thereon. Consequently, in operation, the urging of an envelope 4 aligned with the packing plate 110 by the threading means 108 would separate the envelope front wall 12 from the envelope back wall 14 and thereby open the body 6 of the envelope 4 as depicted in FIG. 7C. In this manner, each consecutive envelope 4 entering the envelope packing assembly 104 may be opened and slide over the packing plate 110.

The packing plate 110 is further configured to part the envelope front wall 12 from the envelope back wall 4 in a manner allowing a packing material 116 to be slide along the packing plate 110 and into opened envelope body 6. In the preferred embodiment, packing plate 110 comprises a front edge 118 having a spreader 120 positioned at each side thereof. The spreaders 120 present a narrow leading edge for the each envelope to first encounter and then get thicker toward an end distal from the front edge 118 of the packing plate 110. A spacer 122 is positioned adjacent each spreader 120 and runs along each side of the packing plate 110. Each spacer presents a vertical portion 124 from which an overhang portion 126 extends over the packing plate 110. In this configuration, the packing plate 110 will hold open an envelope 4 such that packing may slid along the packing plate and into an awaiting envelope 4 without resistance from the envelope 4. It is important that neither the spreaders 120 nor the spacers 122 inhibit the movement of the packing material 116 through the packing plate 110 and off of the packing plate 110 at the front edge 118 thereof. The front edge of the packing plate 110 is also preferably angled inward from each side toward the back edge 140 of the packing plate 110. This results in the V-shaped cut out of the first edge 118 and allows envelopes which employ windows therein to be placed on the packing plate without the window encountering the first edge 118 of the packing plate 110. This configuration therefore allows packing of windowed envelopes without risk of the window being damaged by the packing plate 110. It is of significance to note that because each envelope 4 is lifted onto the packing plate 110 by the threading means 108 the packing plate 110 may, and preferably does, remain stationary throughout the packing process.

The packing of the packing material 116 into each consecutive envelope 4 on the packing plate 110 is accomplished by a packing material conveyor 128 comprising belt 130 and picks 132. The belt 130 is a continuous belt with the picks 132 located thereon. The picks 132 remove each consecutive packing material 116 from a packing material reserve (not shown), slide that packing material 116 along the packing plate 110 and into an awaiting envelope on the packing plate 110.

In addition to facilitating the insertion of the packing material 116 into each consecutive envelope 4, the packing material conveyor 128 preferably serves an additional function of removing each consecutive envelope 4 from the packing plate 110 to an exiting platform 134 positioned laterally adjacent to the packing plate 110. This is accomplished by extending the packing material conveyor 128 past the packing plate 110 and to a point on the exiting platform 134. In this manner, the force exerted by the packing material conveyor 128 onto the packing material 116 will be transferred to the respective envelope 4 on the packing plate 110 when the packing material 116 encounters an envelope bottom 18 of the respective envelope 4 and that envelope 4 will then be propelled onto the exiting platform 134.

Figure 7A:
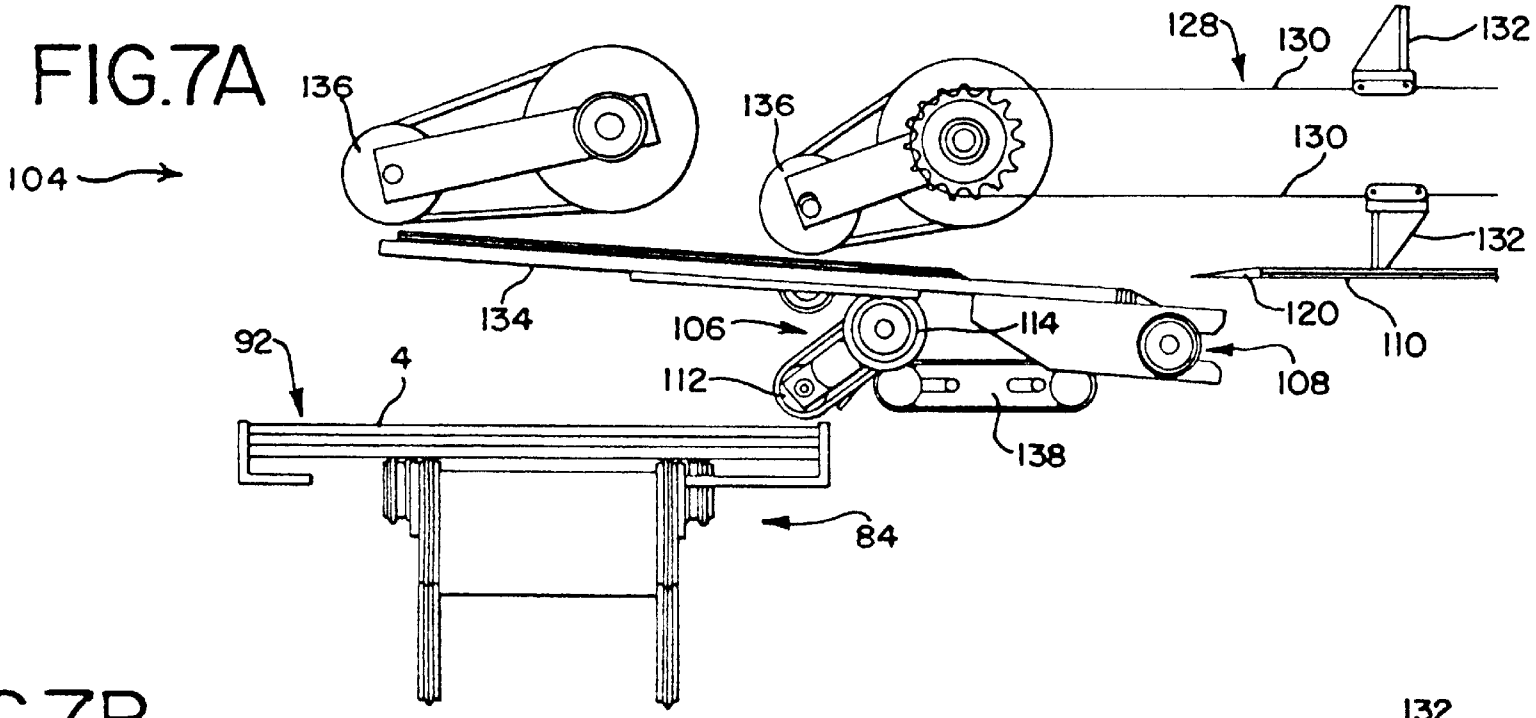
FIG. 7A is a substantially schematic cross-sectional view of the envelope packing assembly and the second bottom feeder.
Figure 7B:
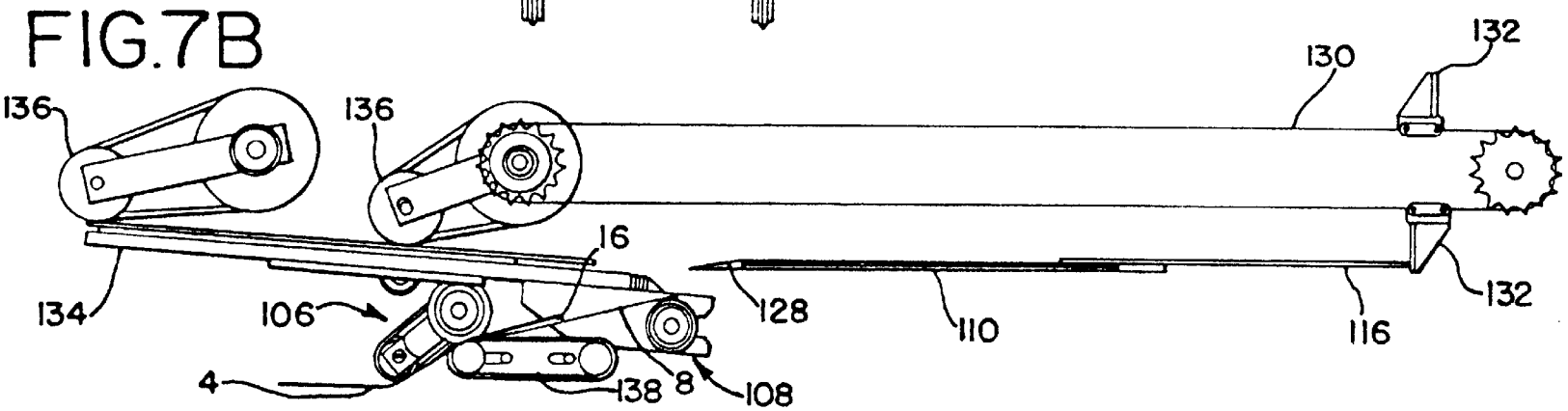
FIG. 7B is a substantially schematic cross-sectional view of the envelope packing assembly with an envelope loaded on the threading conveyor.
Figure 7D:
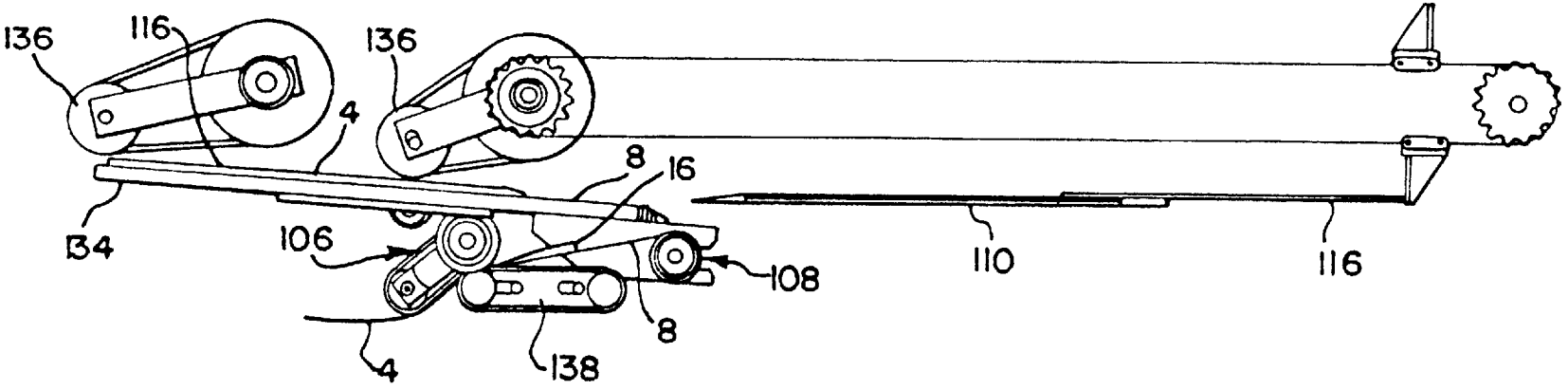
FIG. 7D is a substantially schematic cross-sectional view of the envelope packing assembly with a packed envelope exiting the packing assembly and a new envelope being placed on the threading conveyor.

The advantages of the instant packing assembly 104 are best understood by reference to its operation and by reference to a depiction thereof in each of FIGS. 7B–7D representing the procession of an envelope through the instant envelope packing assembly 104. The threading means 108 is attached to the lower edge of the exiting platform 134 at an end nearest the packing plate 110. The preferred embodiment of the instant packing assembly 104 employs an exiting platform 134 which rotates from a loading position depicted in FIG. 7B to a threading position depicted in FIG. 7C. Furthermore, as will be discussed below, the loading position also serves as an exiting position for loaded envelopes to be removed from the packing plate 110 as the next consecutive envelope is being loaded onto the threading means 108.

FIG. 7B depicts an envelope 4 which has been drawn from the second buffer stack 92 by packing prompter 106 and across the conveyor bridge 138 to be loaded onto threading roller 108. It should be noted that the exiting platform 134 is in the loading position at this time. That position is represented by the exiting platform 134 being lowered toward the bridge conveyor 138. This loaded position allows for empty envelopes to be loaded onto the threading means 108 by packing prompter 106 and bridge conveyor 138.

Once the flap 8 of an envelope has been loaded onto the threading roller 108 as depicted in FIG. 7B, the exiting platform 134, and therefore the threading means 108, shifts upward to the threading position depicted in FIG. 7C. The threading position of the exiting platform 134 positions the envelope flap 8 against a lower side of the packing plate 110 at a position adjacent to the packing plate first edge 118 and threading means 108 presses the envelope flap 8 against said lower side such that the continued urging of the threading means 108 will direct the envelope loaded on the threading means 108 over the front edge 118 of the packing plate 110 and packing plate spreaders 120 will separate the envelope front wall 12 from the envelope back wall 14 at the envelope opening 16. To insure that the envelope 4 will slide along the packing plate 110, the threading roller is comprised of a material, preferably an elastomer, which has a higher coefficient of friction with respect to the envelopes than does the packing plate 110. This accomplishes a mounting of the envelope on the packing plate 110 with the envelope front 12 and envelope back 14 spread to accept packing material 116.

As the envelope is being loaded onto the packing plate 110, the packing picks 132 of the packing material conveyor 128 slide the packing material 116 along the packing plate 110, under the spacer overhang portion 126 and to the back of the envelope. Preferably, the packing material conveyor 128 accelerates the packing material 116 upon contacting it and then decelerates as it reaches the envelope. The acceleration and deceleration of the packing material conveyor 128 would represent a sinusoidal wave form as viewed graphically. Just as the envelope is fully loaded onto the packing plate 110, the packing material 116 will reach the end of the packing plate 110 and therefore the back of the envelope mounted thereon. The fully loaded position need not, and preferably does not, comprise the envelope bottom 18 engaging the packing plate first edge 118. Rather, quicker packing may be accomplished by having packing material 116 engage the envelope bottom 18 prior to said envelope bottom 18 reaching the packing plate first edge 118. The continued motion by the packing picks 132 will remove the packed envelope from the packing plate 110 and onto the exiting platform 134. Once on the exiting platform 134, the packed envelope is pushed off the back of exiting platform 134 by exiting platform conveyors 136 to the exiting conveyors 142. It is important to note that unlike prior art assemblies, the packing picks 132 redirection of the envelope 4 from moving onto the packing plate 110 to moving off the packing plate 110 is the only instance of the instant envelope packing apparatus 2 reversing the momentum of an envelope 4. A more efficient apparatus is thereby accomplished.

Prior to the envelope being slid off of the packing plate 110 by the picks 132, the exiting platform 134 is lowered back to the loading position, depicted in FIG. 7D, such that the envelope on the packing plate 110 may be ejected onto the exiting platform 134. While the packed envelope is being removed to the exiting platform 134 the packing prompter 106 loads another envelope onto the threading means 108 from the second buffer stack 92. The process depicted in FIGS. 7B–7D is then continuously repeated.

Each packed envelope is consecutively removed from the exiting platform 134 by the exiting platform conveyors 136 to the exiting conveyor 142 depicted generally in FIG. 7A–7D. Each envelope leaving the exiting platform 134 falls into a transfer unit 144 (depicted generally in FIG. 9) which then ejects the envelope 4 to a stand-up subassembly 146 which orients the envelope to a vertical position. The envelope flap 8 is then wetted by a reservoir 148 and forced downward against the envelope body 6 by a lick and seal subassembly 150 to accomplish sealing of the envelope.

Figure 10A:
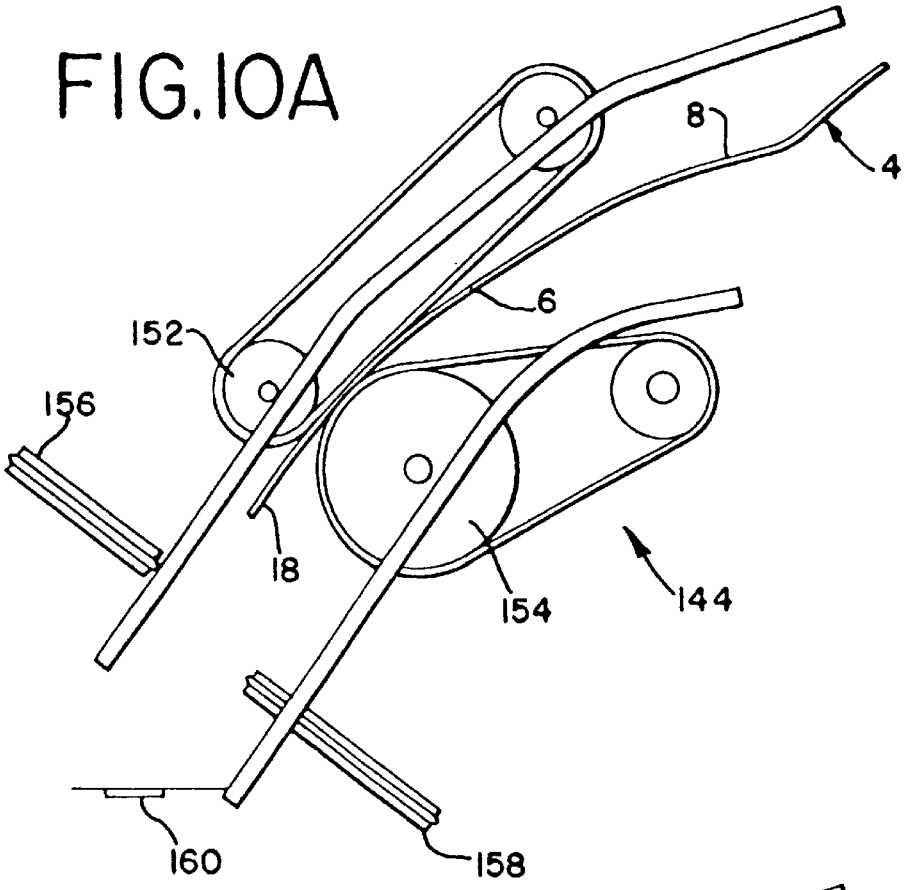
FIG. 10A is a substantially schematic cross-sectional view of the transfer unit of the exiting conveyor accepting an envelope.
Figure 10B:
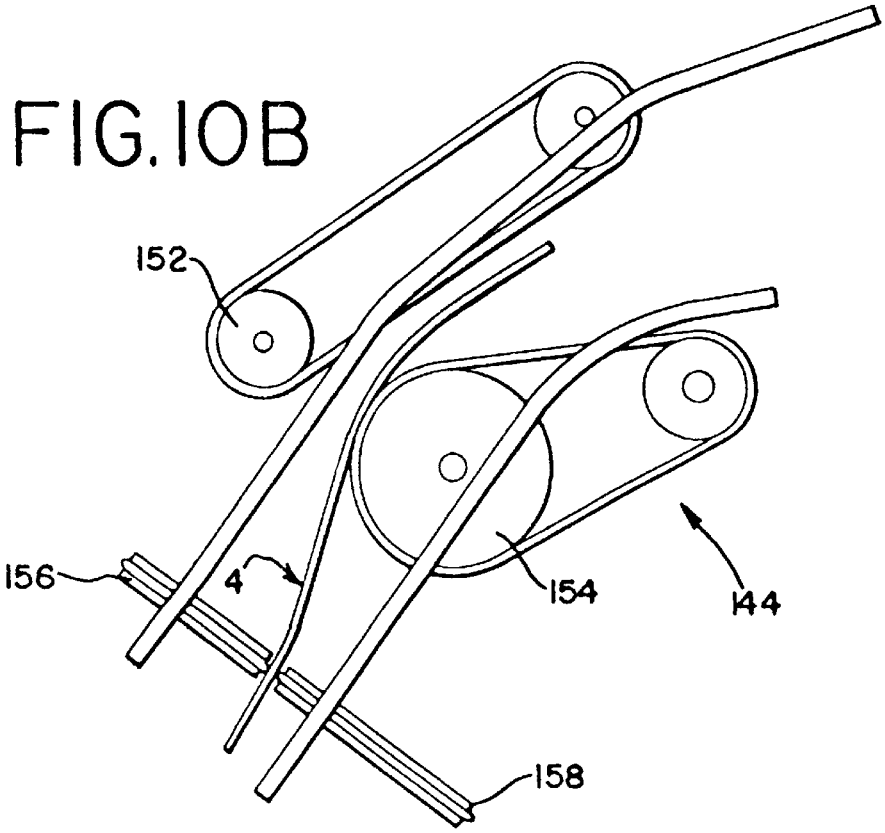
FIG. 10B is a substantially schematic cross-sectional view of the transfer unit of the exiting conveyor ejecting an envelope to the sealing assembly.

The transfer unit 144 is depicted in FIGS. 10A and 10B. FIG. 10A depicts the transfer unit 144 with an envelope 4 positioned therein. Transfer unit 144 comprises a first and second seating conveyor 152,154 which are driven to draw in envelopes 4 deposited therein from above by the packing assembly 104 and seat those envelopes 4 in the transfer unit 144. Transfer unit 144 further comprises a first and second ejection conveyor 156,158 which are driven to eject envelopes 4 from the transfer unit 144 to the stand-up subassembly 146. Ejection conveyors 156,158 are located below the first and second seating conveyors 152,154. Ejection conveyors 156,158 are further positioned at a distance from one another while the seating conveyors are seating an envelope 4 therein to avoid impeding the seating of said envelope 4.

Figure 11A:
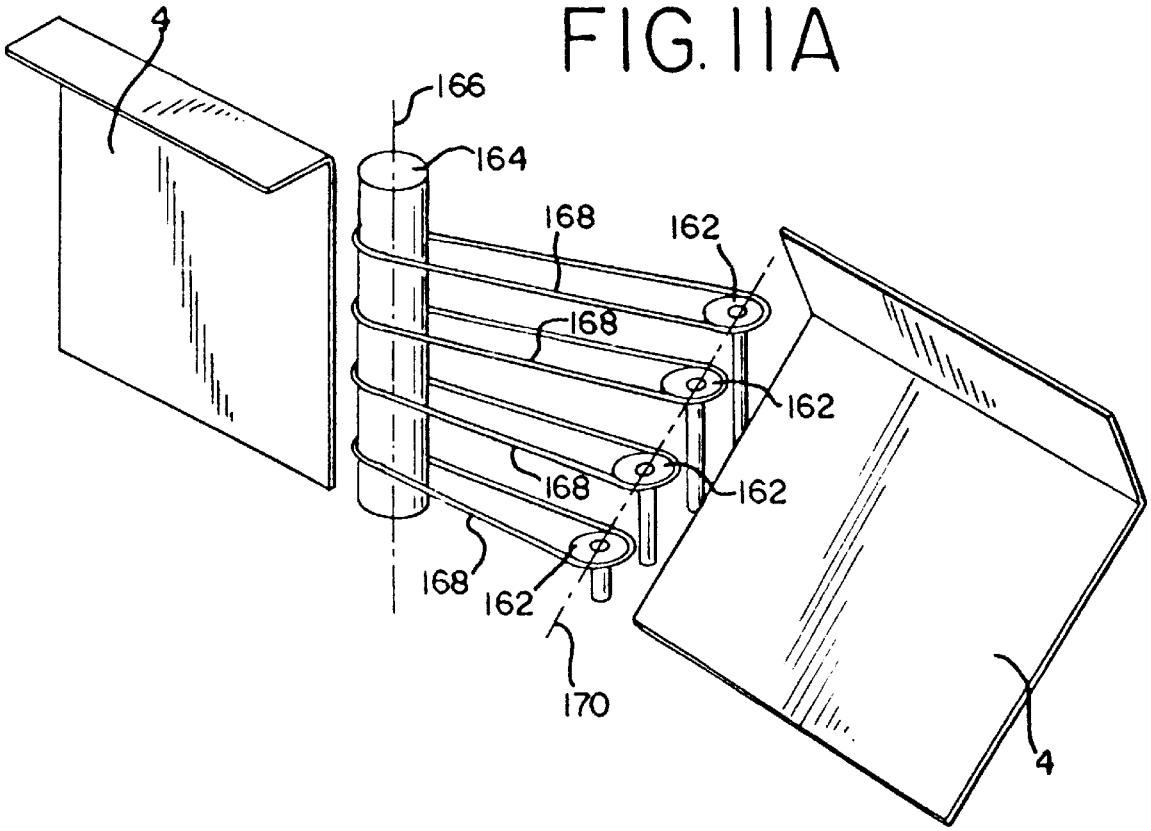
FIG. 11A is a substantially schematic perspective view of the envelope stand-up subassembly of the sealing assembly.

When envelope 4 contacts the seated position in the transfer unit 144, a sensor 160 signals the first seating conveyor 152 to retract and signals the first ejection conveyor 156 to shift toward the second ejection conveyor 158 such that the seated envelope 4 is gripped between the first and second ejection conveyors 156,158 as depicted in FIG. 10B. Once the ejection conveyors 156,158 have a grip on the envelope 4, their rotation ejects said envelope 4 out of the transfer unit to the stand-up subassembly 146 depicted generally in FIG. 11A.

The stand-up subassembly 146 comprises a plurality of pulleys 162 adjacent the exit of the transfer unit. The pulleys 162 are staggered at increasing heights. Adjacent the sealing subassembly is positioned a vertical roller 164 having a vertical axis of rotation 166. A separate belt 168 is placed around each pulley of the plurality of pulleys 162 and the vertical roller 164 such that a plurality of belts 168 extend from the exit of the transfer unit 144 to the sealing subassembly 150 at varying heights. A wall of belts is thereby created between the transfer unit 144 and the sealing subassembly 150.

As well as being staggered in height, the plurality of pulleys 162 are spread out along a line positioned perpendicular to the axis of rotation of the vertical roller 166. With the spreading out of the pulleys 162 in this manner, the pulleys 162 are aligned in a straight line represented by line 170. The placement of the pulleys 162 as describer above contorts the wall of belts between the pulleys 162 and the vertical roller 166. Therefore, the pulleys 162 are positioned adjacent to the exit of the transfer unit 144 and the line 170 of pulleys 162 is conformed to the angle at which the envelopes 4 leave the transfer unit 144. In this configuration, each envelope 4 leaving the transfer unit 144 will be cradled by the belts 168. By imparting continuous rotation to the belts 168 by driving either the pulleys 162 or the vertical roller 164, the belts direct the envelopes 4 from the transfer unit 144 to the sealing subassembly 150. The contorted wall of belts 168 also elevates the envelope from its angled orientation at the pulleys 162 to the vertical orientation dictated by the vertical roller 164. A second preferred embodiment of the stand-up subassembly 146 resembles the first as described above except that alignment line 170 represents the axis of rotation of a second roller and the plurality of belts 168 are replaced by a single belt which extends the length of the roller.

It is important to note that because the envelope bottom 18 represented the leading edge of the envelope 4 as it was removed from the packing plate 110 and subsequently the exiting platform 134, said envelope 4 lands with the bottom 18 at the bottom of the transfer unit 144. Therefore, when the envelope 4 is elevated to a vertical position by the stand-up subassembly 146, the flap 8 of said envelope 4 was at the uppermost portion thereof.

Figure 9:
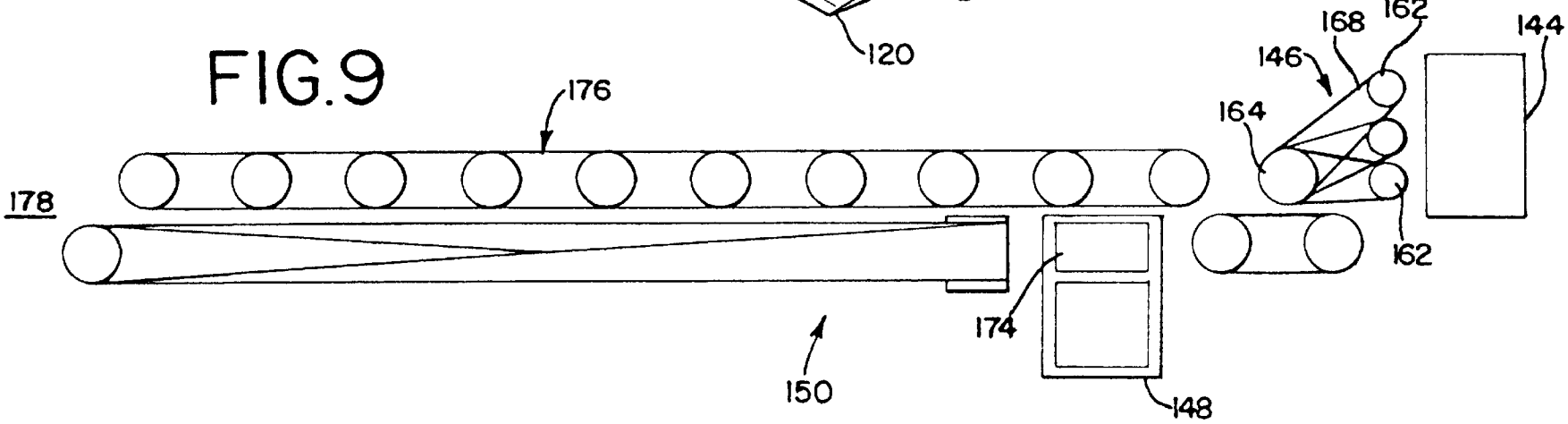
FIG. 9 is a substantially schematic top view of the exiting conveyor.
Figure 11B:
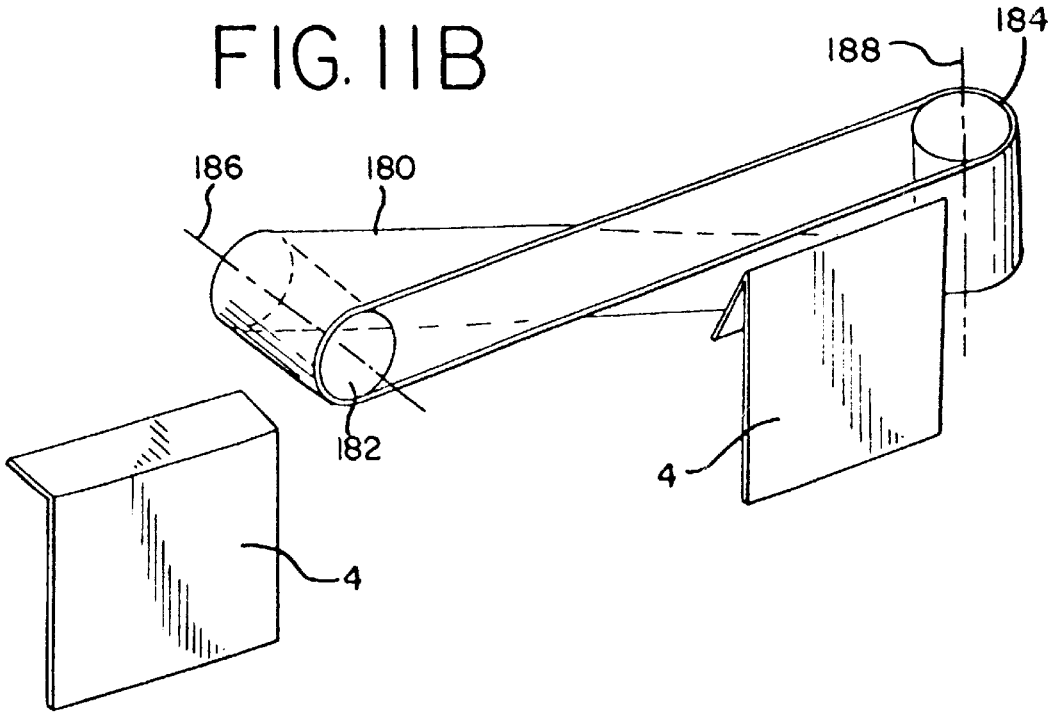
FIG. 11B is a substantially schematic perspective view of the envelope lick and seal subassembly of the sealing assembly.

The sealing subassembly 150 is depicted in FIGS. 9 and 11B. As each envelope 4 enters the sealing subassembly 150 the vertical orientation of the envelope 4 should cause the envelope flap 8 to fall to approximately a horizontal position. However, if the stiffness of the envelopes employed in the envelope packing apparatus 2 is such that the flaps 8 do not fall to a horizontal position upon being elevated to a horizontal position, or of a stiffness such that the flap 8 falls beyond the horizontal position, a flap rotating assembly 172 may be placed at the entrance to the sealing subassembly such that the flap 8 is rotated to a horizontal position such that it is perpendicular to the envelope body 6.

Once a horizontal flap 8 is achieved, the envelope is passed into the reservoir 148 where the horizontal flap 8 of the envelope 4 is run over a bead of water to moisten the adhesive on the flap 8 of said envelope 4. The reservoir is a pressurized water reserve which is placed under an appropriate pressure to form a continuous bead of water at the top thereof. The motion of envelope 4 is imparted by a sealing conveyor 176 which directs each envelope 4 from the transfer unit 144 to the exit 178 of the envelope packing apparatus 2.

The moistened flap 8 is then directed to a sealing belt 180. The sealing belt 180 is a wide belt which presents a wall to the flap 8. Sealing belt 180 is run around a first and second sealing belt roller 182, 184 which impart rotation to said belt 180. The axis of rotation 186 of the first sealing belt roller 182 is positioned horizontally such that the wall presented by the sealing belt 180 will conform with the horizontal position of the flap 8 as the envelope 4 encounters t he sealing belt 180. However, the axis of rotation 188 of the second sealing belt roller 184 is positioned vertically such that the wall which the flap 8 encounters gradually adjusts from horizontal to vertical between the firs t and second sealing belt rollers 182,184. As a result, the flap 8 of any envelope 4 which encounters the sealing belt will be directed downward and into contact with the envelope body 6. Upon said contact, the moistened adhesive on the flap 8 will bond the flap 8 to the body 6 and accomplish a sealed envelope. Upon accomplishing a sealed envelope, the sealing conveyor continues direction of the envelope 4 to the exit 178 of the envelope packing apparatus 2. Any means of collecting or collating the sealed envelopes is contemplated.

The foregoing specification describes only the preferred embodiment of the invention as shown. Other embodiments besides those presented above may be articulated as well. The terms and expressions therefore serve only to describe the invention by example only and not to limit the invention. It is expected that others will perceive differences which while differing from the foregoing, do not depart from the spirit and scope of the invention herein described and claimed.

We claim:

1. An envelope packing apparatus for packing a plurality of envelopes with packing material comprising:

a reserve means for supplying said plurality of envelopes;

a flap opening means positioned adjacent to said reserve means for opening a flap of one of said envelopes while said envelope is located in said reserve means wherein said flap is opened by an air stream directed toward said plurality of envelopes:

a distinct buffer stack means for accumulating a stack of said envelopes from said reserve means wherein said buffer stack means places opened envelopes at a bottom of said stack of envelopes; and a packing assembly for accepting each of said envelopes from said buffer stack and inserting said packing material into said envelopes, wherein the operation of said packing assembly is not synchronously dependant on the operation of said reserve means.

2. The envelope packing apparatus of claim 1 further comprising a defect detection and rejection assembly positioned between the reserve means and the buffer stack means and wherein said defect detection and rejection assembly detects whether said flap of each said envelope is open.

3. The envelope packing apparatus of claim 2 wherein the buffer stack means comprises a bottom feeder located adjacent to a bottom of said buffer stack for placing envelopes at the bottom of said stack and said buffer stack means provides a substantially continuous supply of envelopes to said packing assembly whereby said packing assembly may operate substantially continuously.

4. The envelope packing apparatus of claim 1 wherein said packing assembly comprises a packing plate for accepting each of said envelopes and holding said envelope open such that said packing material may be inserted therein, said packing plate remaining stationary.

5. The envelope packing apparatus of claim 4 further comprising:

an exiting platform laterally adjacent to said packing plate; and a threading means adjacent to said packing plate for placing said envelopes on said packing plate.

6. The envelope packing apparatus of claim 5 further comprising a packing prompter positioned adjacent to a top of said buffer stack means for drawing one of said accumulated envelopes toward said threading means.

7. The envelope packing apparatus of claim 4 further comprising a threading means wherein said threading means is adapted to press the flap of each consecutive envelope against said packing plate.

8. The envelope packing assembly of claim 4, wherein said packing plate comprises a front edge having a notch extending along at least a portion thereof.

9. The envelope packing assembly of claim 7, wherein said threading means comprises a means for urging said envelope onto said packing plate.

10. An envelope packing assembly for packing envelopes with a packing material comprising:

a stationary packing plate adapted to accept an envelope thereon such that said packing material may be inserted into said envelope; and a threading means adapted to travel from an envelope loading position for receiving the envelope thereon, to an envelope threading position adjacent to said packing plate and wherein said envelope threading position comprises said threading means pressing a flap of said envelope against said packing plate such that a front edge of said packing plate will force open a body of said envelope when said envelope is urged onto said packing plate.

11. The envelope packing assembly of claim 10 wherein said threading means presses said flap against a first side of said packing plate, wherein said packing material is inserted into said envelope along a second side of said packing plate.

12. The envelope packing assembly of claim 10 wherein said envelope is removable from the packing plate when the threading means is in the envelope loading position.

13. The envelope packing assembly of claim 10 further comprising an exiting platform laterally adjacent to said packing plate wherein said threading means is fixed to said exiting platform.

14. The envelope packing assembly of claim 10 further comprising:

a buffer stack means for holding an accumulated stack of opened envelopes; and a packing prompter positioned adjacent to said buffer stack means for drawing one of said accumulated envelopes toward said threading means.

15. The envelope packing assembly of claim 14 wherein said buffer stack means comprises a bottom feeder located adjacent to a bottom of said stack of envelopes, wherein said bottom feeder is adapted to place envelopes having a flap in an opened position at the bottom of said stack with the envelope flap comprising the leading edge of the envelope when entering the buffer stack means at the bottom feeder and said envelope comprising a window facing downward from said stack of envelopes when placed therein.

16. The envelope packing assembly of claim 15 wherein the envelopes received by said bottom feeder have been checked by a defect detection and rejection means and wherein the defect detection and rejection means removes from the stream of envelopes, each of said envelopes which has not been opened.

17. The envelope packing assembly of claim 10, wherein said packing plate comprises a front edge having a notch along a portion thereof such that a window of said envelope placed on said packing plate will remain substantially untouched by said packing plate.

18. The envelope packing assembly of claim 11, wherein said envelope threading means comprises a threading roller configured to urge said envelope onto said packing plate.

19. A met,hod of packing an envelope with a packing material comprising the steps of:

providing a threading means and a stationary packing plate adjacent to said threading means;

holding said envelope against a first side of said packing plate with said threading means wherein said threading means pressing said envelope flap against the first side of said packing plate and urging said envelope onto said packing plate such that a body of the envelope is forced open by a front edge of said packing plate; and stuffing said envelope with said packing material wherein said packing material is adjacent to a second side of said packing plate.

20. The method of claim 19 wherein a front edge of said packing plate having a notch therealong.

21. The method of claim 19 further comprising the step of:

placing said envelope on said threading means when said threading means is in an envelope loading position; and shifting the threading means toward the packing plate into an envelope threading position.

22. The method of claim 21, wherein the step of shifting the threading means toward the packing plate comprises:

providing an exiting platform laterally adjacent to said packing plate and fixing said threading means to said exiting platform; and shifting the exiting platform toward the packing plate.

23. The method of claim 19, wherein the step of placing an envelope on said threading means comprises:

providing a buffer stack of envelopes adjacent to said exiting platform, said buffer stack having a first end and second end;

removing said envelope from the second end of said buffer stack; and placing a replacement envelope at the first end of said buffer stack with said flap comprising said leading edge of said envelope.

24. The method of claim 23, wherein the step of placing a replacement envelope at the first end of said buffer stack comprises:

providing an envelope source and a defect detection and rejection means between said envelope source and said buffer stack;

drawing said replacement envelope from the envelope source to the defect detection and rejection means;

checking said replacement envelope with the defect detection and rejection means to determine whether flap of said undetected envelope is open or closed;

placing said replacement envelope at the first end of said buffer stack if said flap is open; and deflecting said replacement envelope from said buffer stack if said flap is closed.

25. An envelope packing assembly for packing envelopes with a packing material comprising:

a packing plate adapted to accept an envelope thereon such that said packing material may be inserted into said envelope; and a threading means wherein a flap of said envelope is pressed between said packing plate and said threading means such that a front edge of said packing plate will force open a body of said envelope when said envelope is urged onto said packing plate.

* * * * *